US012006106B2

(12) United States Patent
Paley

(10) Patent No.: US 12,006,106 B2
(45) Date of Patent: Jun. 11, 2024

(54) PACKAGING SYSTEM FOR A HOT WATER HEATER

(71) Applicant: Smurfit Kappa North America LLC, Irving, TX (US)

(72) Inventor: Marcus De'shune Paley, Round Rock, TX (US)

(73) Assignee: SMURFIT KAPPA NORTH AMERICA LLC, Irving, TX (US)

( * ) Notice: Subject to any disclaimer, the term of this patent is extended or adjusted under 35 U.S.C. 154(b) by 0 days.

(21) Appl. No.: 17/820,771

(22) Filed: Aug. 18, 2022

(65) Prior Publication Data

US 2023/0057585 A1 Feb. 23, 2023

Related U.S. Application Data

(60) Provisional application No. 63/234,863, filed on Aug. 19, 2021.

(51) Int. Cl.

| | |
|---|---|
| ***B65D 5/50*** | (2006.01) |
| ***B65D 81/02*** | (2006.01) |
| ***B65D 85/68*** | (2006.01) |
| *F24H 1/00* | (2022.01) |

(52) U.S. Cl.

CPC ..... *B65D 5/5052* (2013.01); *B65D 65/44* (2013.01); *B65D 85/68* (2013.01); *B65D 2585/6857* (2013.01); *F24H 1/0018* (2013.01); *F24H 1/0027* (2013.01)

(58) Field of Classification Search

CPC ..... B65D 5/50; B65D 5/5052; B65D 65/44; B65D 85/64; B65D 85/68; B65D 2585/6857; F24H 1/0018; F24H 1/0027

USPC ..... 206/320

See application file for complete search history.

(56) References Cited

U.S. PATENT DOCUMENTS

| | | | | | |
|---|---|---|---|---|---|
| 1,852,832 | A | * | 4/1932 | Beaman | B65D 85/64 206/586 |
| 2,321,063 | A | * | 6/1943 | Bohnke | B65D 85/64 206/320 |
| 4,881,641 | A | * | 11/1989 | Mattingly | B65D 85/68 206/320 |
| 4,955,474 | A | * | 9/1990 | Mattingly | B65D 85/68 206/320 |

(Continued)

FOREIGN PATENT DOCUMENTS

| | | | | |
|---|---|---|---|---|
| CN | 202295545 | U | * 7/2012 | |
| CN | 215157437 | U | * 12/2021 | |
| JP | 2004262475 | A | * 9/2004 | B65D 85/68 |

*Primary Examiner* — Bryon P Gehman

(74) *Attorney, Agent, or Firm* — Baker Botts L.L.P.

(57) ABSTRACT

A packaging system for a hot water heater includes an outer box, a top insert, an offset filler, a base insert, and one or more side panels. The top insert contacts a top surface of the hot water heater and a top inside surface of outer box. The offset filler is coupled to the top insert and is sandwiched between the hot water heater and the outer box. The base insert contacts the bottom surface of the hot water heater and a bottom inside surface of the outer box. The base insert includes raised perimeter structures that form a shape that matches a shape of the bottom surface of the hot water heater. The raised perimeter structures and the offset filler position the hot water heater off-center with respect to a center axis of the outer box. Each side panel includes a raised pattern.

19 Claims, 25 Drawing Sheets

(56) References Cited

U.S. PATENT DOCUMENTS

| | | | | |
|---|---|---|---|---|
| 6,126,002 | A * | 10/2000 | Brown | B65D 85/64 206/320 |
| 7,648,026 | B2 * | 1/2010 | Brittain | B65D 85/30 206/320 |
| 2011/0315749 | A1 * | 12/2011 | Brittain | B65D 85/68 229/87.02 |
| 2020/0277099 | A1 * | 9/2020 | Wenner | B65D 5/5052 |

* cited by examiner

PACKAGING SYSTEM FOR A HOT WATER HEATER

BENEFIT CLAIM

This application claims the benefit of provisional application 63/234,863, filed Aug. 19, 2021, the entire contents of which are hereby incorporated by reference for all purposes as if fully set forth herein, under 35 U.S.C. § 119(e).

TECHNICAL FIELD

This disclosure generally relates to a packaging system, and more specifically to a packaging system for a hot water heater.

BACKGROUND

Transporting hot water heaters requires care and proper packaging to protect the hot water heater from damage. Typical packaging for hot water heaters is bulky, expensive, and may not be recyclable. Thus, there is a need to provide packaging for a hot water heater that is streamlined and recyclable as well as improves the protection of the hot water heater during transport.

SUMMARY OF PARTICULAR EMBODIMENTS

According to some embodiments, a packaging system for a hot water heater includes an outer box, a top insert, an offset filler, a base insert and one or more side panels. The hot water heater includes a top surface, a bottom surface, and an elongated portion. The outer box is configured to contain the hot water heater and includes a top inside surface and a bottom inside surface. The top insert is configured to contact the top surface of the hot water heater and the top inside surface of the outer box. The top insert includes a slot configured to align with a component on the top surface of the hot water heater. The offset filler is coupled to the top insert and is configured to be sandwiched between the elongated portion of the hot water heater and the outer box. The base insert is configured to contact the bottom surface of the hot water heater and the bottom inside surface of the outer box. The base insert includes one or more raised perimeter structures configured to form a shape that matches a shape of the bottom surface of the hot water heater. The one or more raised perimeter structures on the base insert and the offset filler are configured to position the hot water heater off-center with respect to a center axis of the outer box. Each of the one or more side panels includes a raised pattern and an L-shape that includes a short portion and a long portion. The short portion of the L-shape in each of the one or more side panels is configured to be inserted between the top insert and the top surface of the hot water heater. The long portion of the L-shape in each of the one or more side panels is configured to be sandwiched between the elongated portion of the hot water heater and the outer box.

According to some embodiments, a packaging system for a hot water heater includes an outer box, a top insert, a base insert, and a center collar. The hot water heater includes a top surface, a bottom surface and an elongated portion that includes a mid-portion. The outer box is configured to contain the hot water heater and includes a top inside surface and a bottom inside surface. The top insert is configured to contact the top surface of the hot water heater and the top inside surface of the outer box. The top insert includes a slot that is configured to align with a component on the top surface of the hot water heater. The top insert includes one or more first raised perimeter structures that are configured to form a first shape that matches a shape of the top surface of the hot water heater. The base insert is configured to contact the bottom surface of the hot water heater and the bottom inside surface of the outer box. The base insert includes one or more second raised perimeter structures. The one or more second raised perimeter structures are configured to form a second shape that matches a shape of the bottom surface of the hot water heater. The one or more second raised perimeter structures are further configured to position the hot water heater at a center axis of the outer box. The center collar is coupled around the mid-portion of the elongated portion of the hot water heater. The center collar includes one or more raised patterns. The one or more raised pattern of the center collar is configured to contact the outer box.

According to some embodiments, a packaging system for a hot water heater includes an outer box, a top insert, a base insert, and one or more side objects. The hot water heater includes a top surface, a bottom surface, and an elongated portion. The outer box is configured to contain the hot water heater. The top insert is configured to be placed between the top surface of the hot water heater and the outer box. The top insert includes a slot that is configured to align with a component on the top surface of the hot water heater. The top insert includes a first perimeter structure that is configured to form a shape that matches a shape of the top surface of the hot water heater. The base insert is configured to contact the bottom surface of the hot water heater and a bottom inside surface of the outer box. The base insert includes a second perimeter structure that is configured to form a shape that matches a shape of the bottom surface of the hot water heater. Both the first perimeter structure of the top insert and the second perimeter structure of the base insert are configured to position the hot water heater intact with respect to a center axis of the outer box. Each of the one or more side objects include a raised pattern and is configured to be sandwiched between the elongated portion of the hot water heater and the outer box.

Technical advantages of certain embodiments may include providing a packaging system that is inexpensive, quick to assemble, easy to use, and is recyclable. The packaging system may permit the system to be easily and quickly assembled. The packaging system includes a top insert and a base insert that may have perforations, apertures, and cutouts to accommodate one or more components (e.g., valves, vent hoods, etc.) of the hot water heater. Additionally, the perforations, apertures, and cutouts reduce the amount of time and effort to pack the hot water heater and contain it in the outer box. The packaging system may be made from recyclable materials such as cardboard (e.g., corrugated or honeycomb cardboard). The honeycomb base eliminates the current base assembly process and helps in keeping the hot water heater unit in place as well as providing kick resistance and cushioning during an impact/accidental fall.

Other technical advantages will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

FIGS. 4A-40 illustrate side panels, according to certain embodiments.

DESCRIPTION OF EXAMPLE EMBODIMENTS

Transporting hot water heaters requires care and proper packaging to protect the hot water heater from damage. Typical packaging for hot water heaters is bulky, expensive, and may not be recyclable. Thus, there is a need to provide packaging for a hot water heater that is streamlined and recyclable as well as improves the protection of the hot water heater during transport.

As a specific example, a hot water heater, which typically includes a gas hot water heater and/or an electric hot water heater, requires a tight packaging system that can keep the hot water heater safe from accidental falls, damage, and impacts by packing the hot water heater in a packaging box in which it is shipped or transported. In some conventional systems, a common packaging is utilized for both kinds of hot water heaters which fail to accommodate additional components of hot water heater such as vent hoods, valves, and some electric components. In this way, the hot water heater may be prone to impacts and damages.

To address these and other problems with existing packaging, the teachings of the disclosure provide a packaging system that includes a top insert, a base insert, side panels, a center collar and an offset filler that are inexpensive and easy and quick to assemble and are made from recyclable materials (e.g., corrugated or honeycomb cardboard). Some disclosed embodiments include offset filler that fills the space between the hot water heater and an outer box i.e., the packaging box. The usage of the offset filler provides protection to the hot water heater and aids in positioning the hot water heater at a proper location within the outer box. In some embodiments, a center collar is used to protect the electric hot water heater from damages. Additionally, some embodiments include a top insert and a base insert with perforations, apertures, and cutouts which help in accommodating additional components (e.g., vent hoods, valves etc.) of the hot water heater. This reduces the amount of time and effort to pack the hot water heater and contain it in the outer box. In some embodiments, various system components are configured differently for different types of hot water heaters which are explained in later sections herein.

Figure 1A:
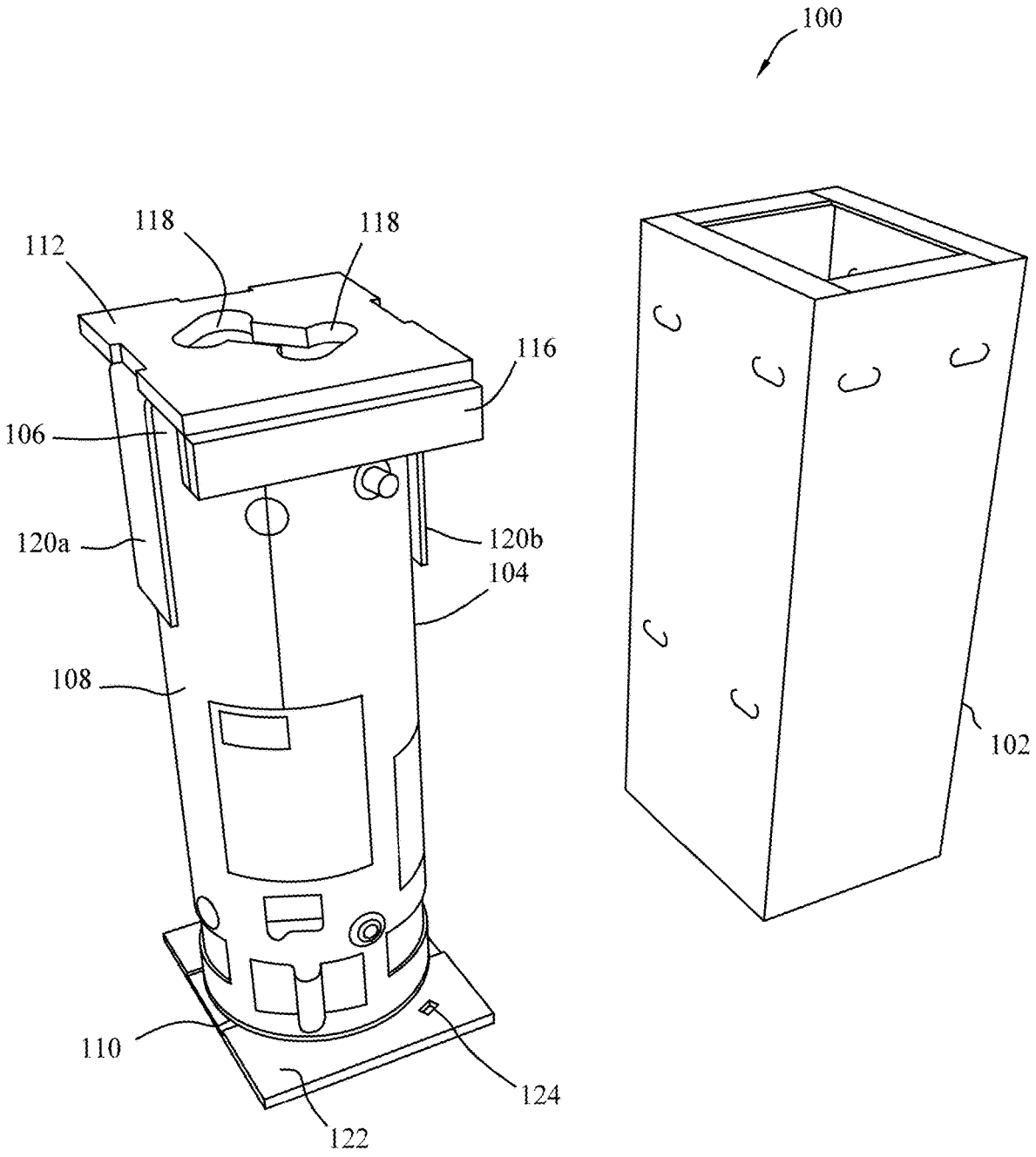
FIGS. 1A-1C illustrate a packaging system for gas hot water heater, according to certain embodiments.
Figure 1B:
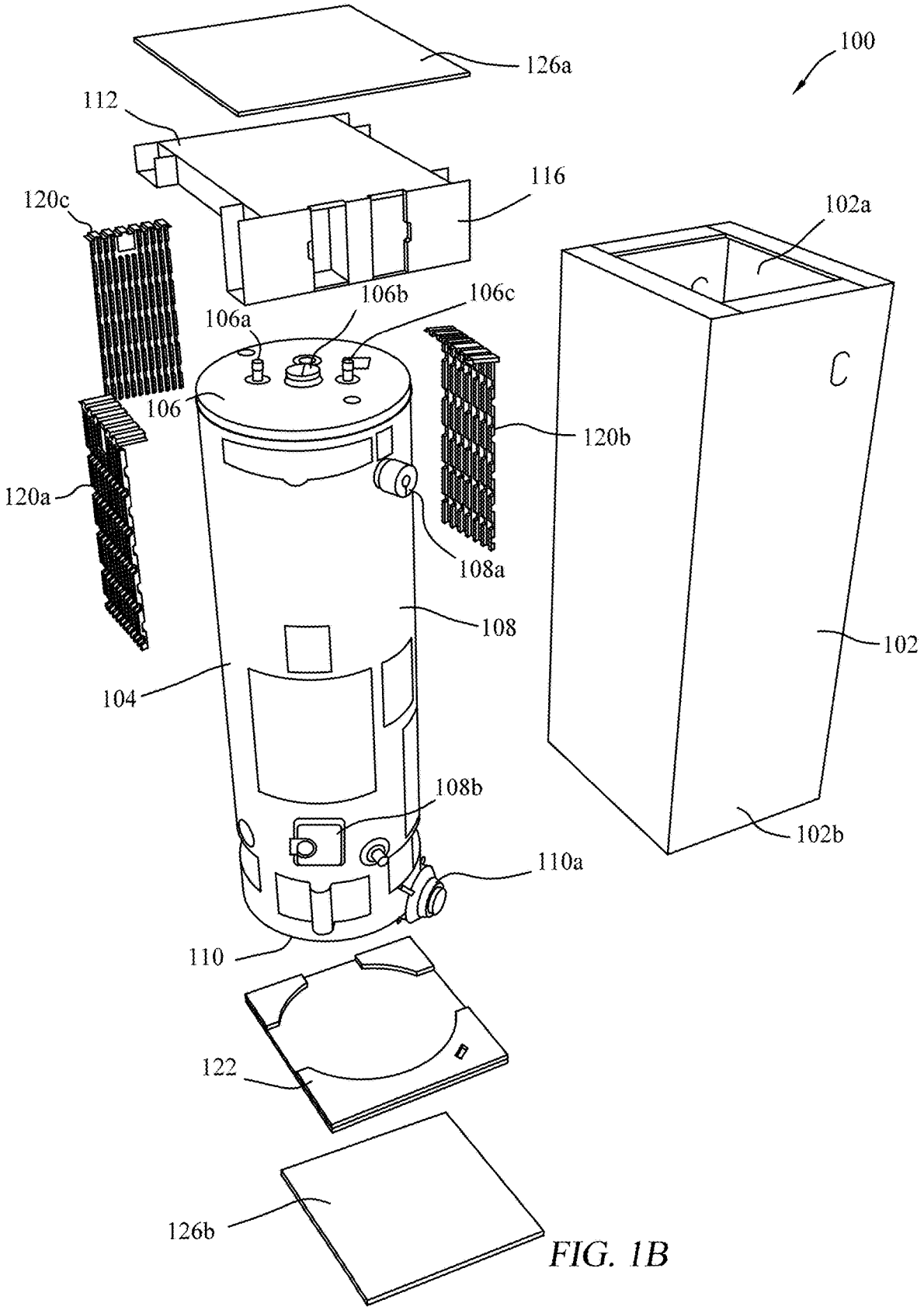
Figure 1C:
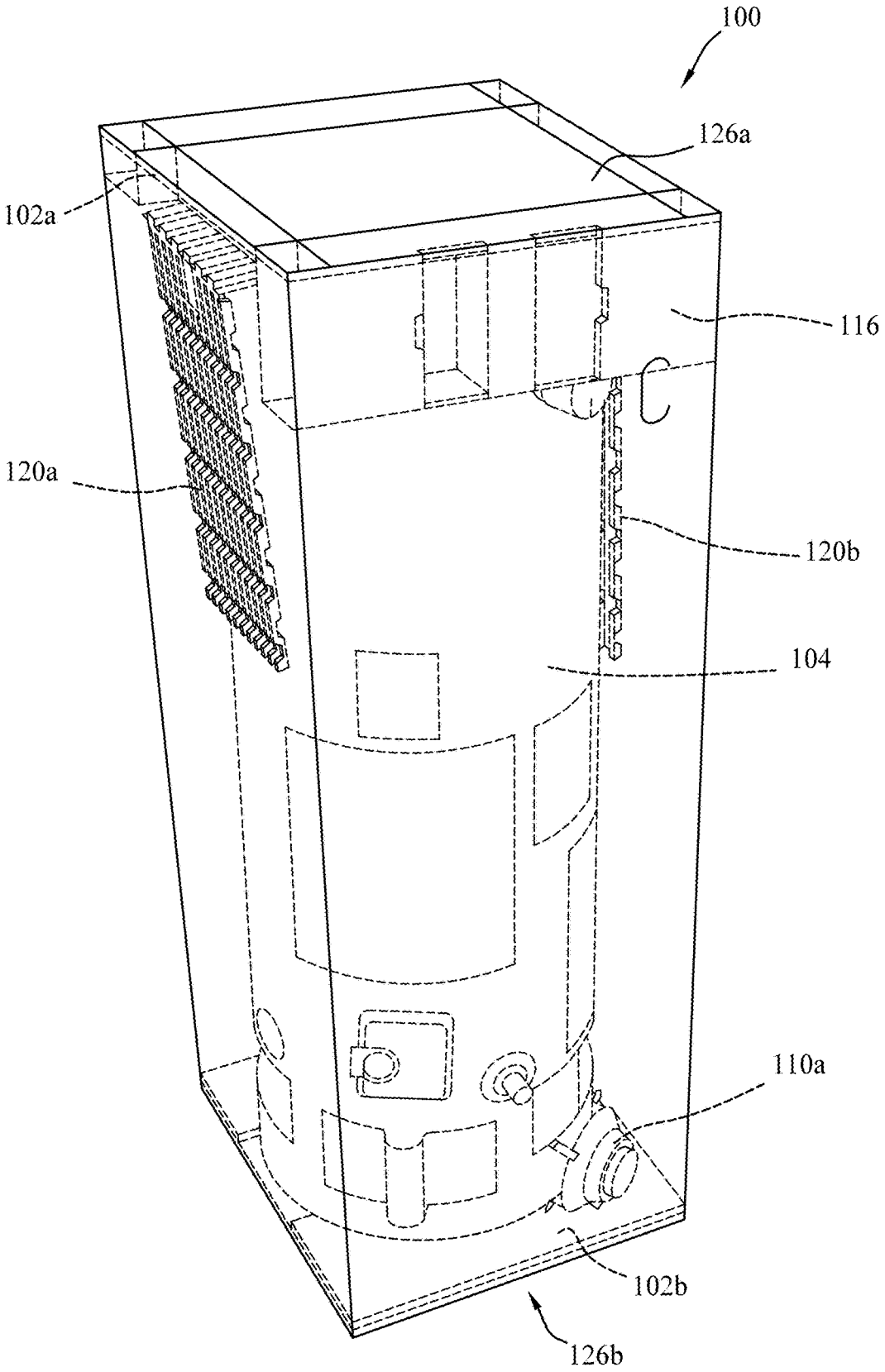
Figure 2A:
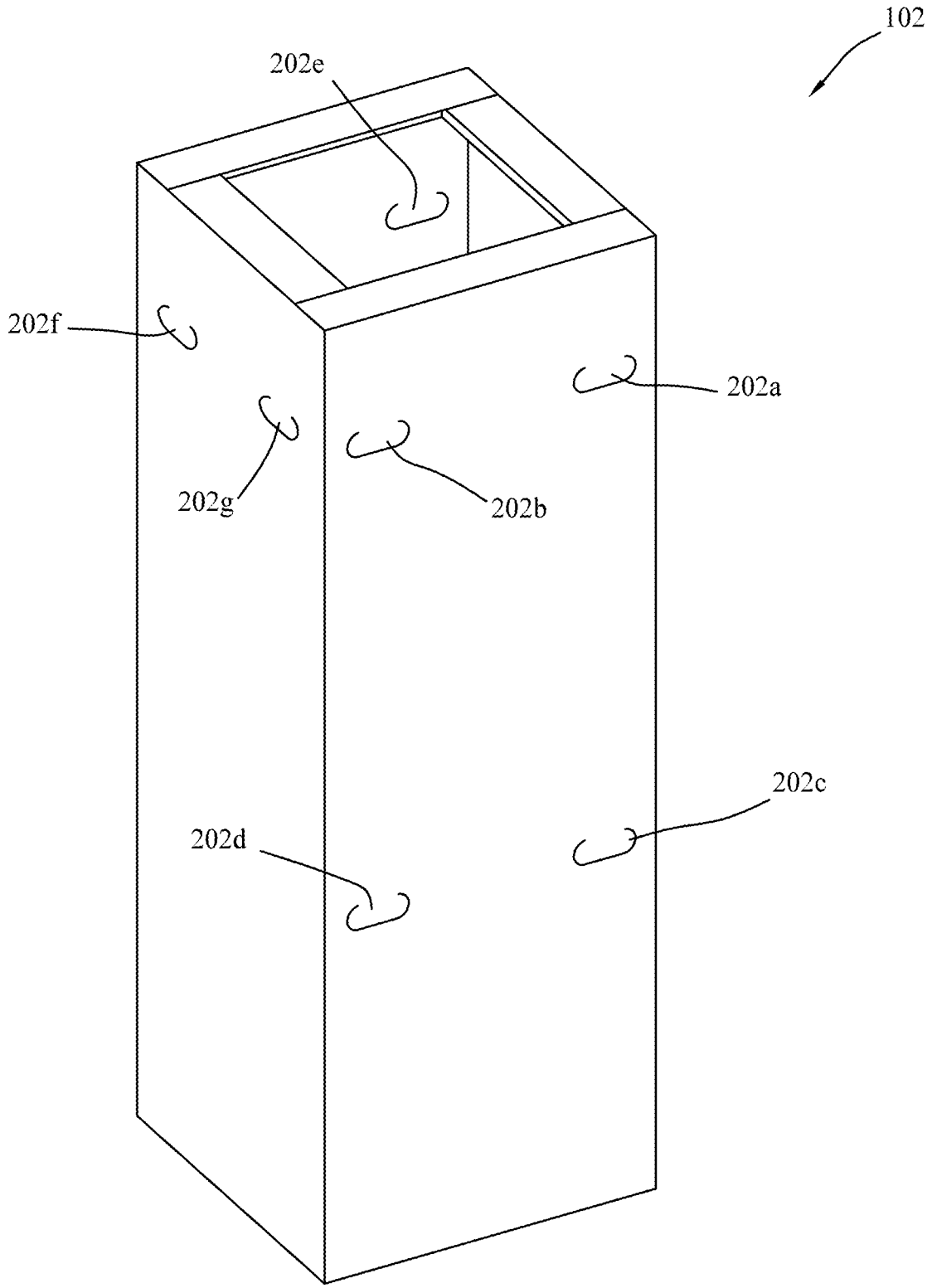
FIGS. 2A-2B illustrate an outer box, according to certain embodiments.
Figure 2B:
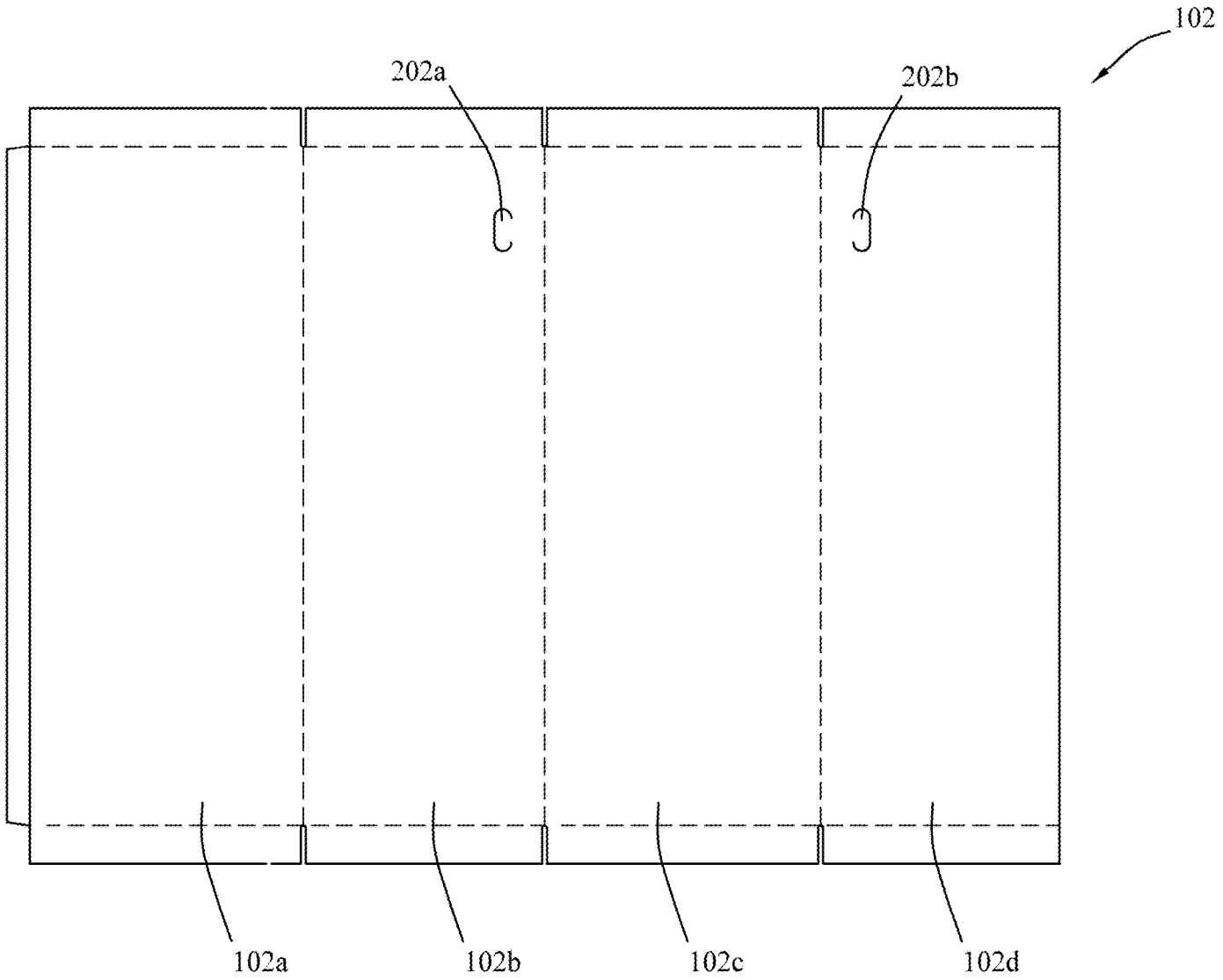

FIGS. 1A, 1B, and 1C illustrate a packaging system for a gas hot water heater; FIG. 2A illustrates an outer box and FIG. 2B illustrates a lay-flat outer box that when assembled forms the outer box of FIGS. 1A and 2A; FIGS. 3A-3E illustrate a top insert and its configurations along with an offset filler coupled to the top insert of FIGS. 1A-1C; FIGS. 4A-40 illustrate side panels of FIGS. 1A-1C; FIGS. 5A-5C illustrate a base insert of FIGS. 1A-1C and its configurations; FIGS. 6A-6D illustrate a packaging system for an electric hot water heater; and FIGS. 7A-7D illustrate a top insert and a base insert for an electric hot water heater, according to certain embodiments.

FIG. 1A illustrates a packaging system 100, according to certain embodiments. Packaging system 100 may include an outer box 102, a hot water heater 104, a top insert 112, an offset filler 116, a base insert 122, and one or more side panels 120 (e.g., 120*a* and 120*b*). In some embodiments, each of the outer box 102, the top insert 112, the offset filler 116, the base insert 122, and the one or more side panels 120*a* and 120*b* may be made from recyclable materials including, but not limited to, cardboard, fiberboard, linerboard, and the like. In some embodiments, each of the outer box 102, the top insert 112, the offset filler 116, the base insert 122, and the one or more side panels 120*a* and 120*b* may be corrugated cardboard or honeycomb cardboard as shown in FIGS. 2A-2B, FIGS. 3A-3E, FIGS. 4A-40, and FIGS. 5A-5C.

In particular, a packaging system 100 containing the top insert 112, base insert 122, side panels 120*a*, 120*b*, and offset filler 116 provides an inexpensive and easy- and quick-to-assemble packing assembly. Packaging system 100 provides a quicker and more convenient solution to packaging gas hot water heaters than typical systems. Packaging system 100 reduces the amount of time and effort to pack the hot water heater and contain it in the outer box 102, which prevents damage from impacts and falls during shipping.

In some embodiments, outer box 102 may be made from recyclable materials such as cardboard (e.g., corrugated or honeycomb cardboard). Outer box 102 may be a predefined shaped box including, but not limited to, a cube shaped box, a rectangular shaped box, and a rectangular cuboid shaped box. Outer box 102 has any appropriate dimensions to accommodate any type of hot water heater (e.g., a gas or electric hot water heater).

FIGS. 2A and 2B illustrate various embodiments of outer box 102. FIG. 2B illustrates an outer box cutout before folding and assembling into the outer box 102 of FIG. 1A and FIG. 2A. In an exemplary embodiment, in FIG. 2B, the outer box cutout includes four cutouts 102*a*, 102*b*, 120*c* and 102*d*. Each cutout is rectangular in shape with dimensions best suited for gas hot water heater 104. In an embodiment, the outer box cutout may include one or more perforations 202*a*, 202*b*, 202*c*, 202*d*, 202*e*, 202*f*, and 202*g* that may align with objects on hot water heater 104 and/or to provide locations for a person to lift outer box 102.

The hot water heater 104 includes a top surface 106, an elongated portion 108 and a bottom surface 110 as shown in FIGS. 1A and 1B. The top surface 106 may include components 106*a*, 106*b*, and 106*c*, as an example, that may be located on a typical hot water heater. Similarly, the elongated portion 108 of the hot water heater 104 may include components either protruded outwards and/or inwards. As an example, FIG. 1B shows components 108*a* and 108*b* (e.g., electrical components or water connection components) coupled to or attached to the elongated portion 108, where such components represent any components that typically exist in the elongated portion of any hot water heater.

Figure 3A:
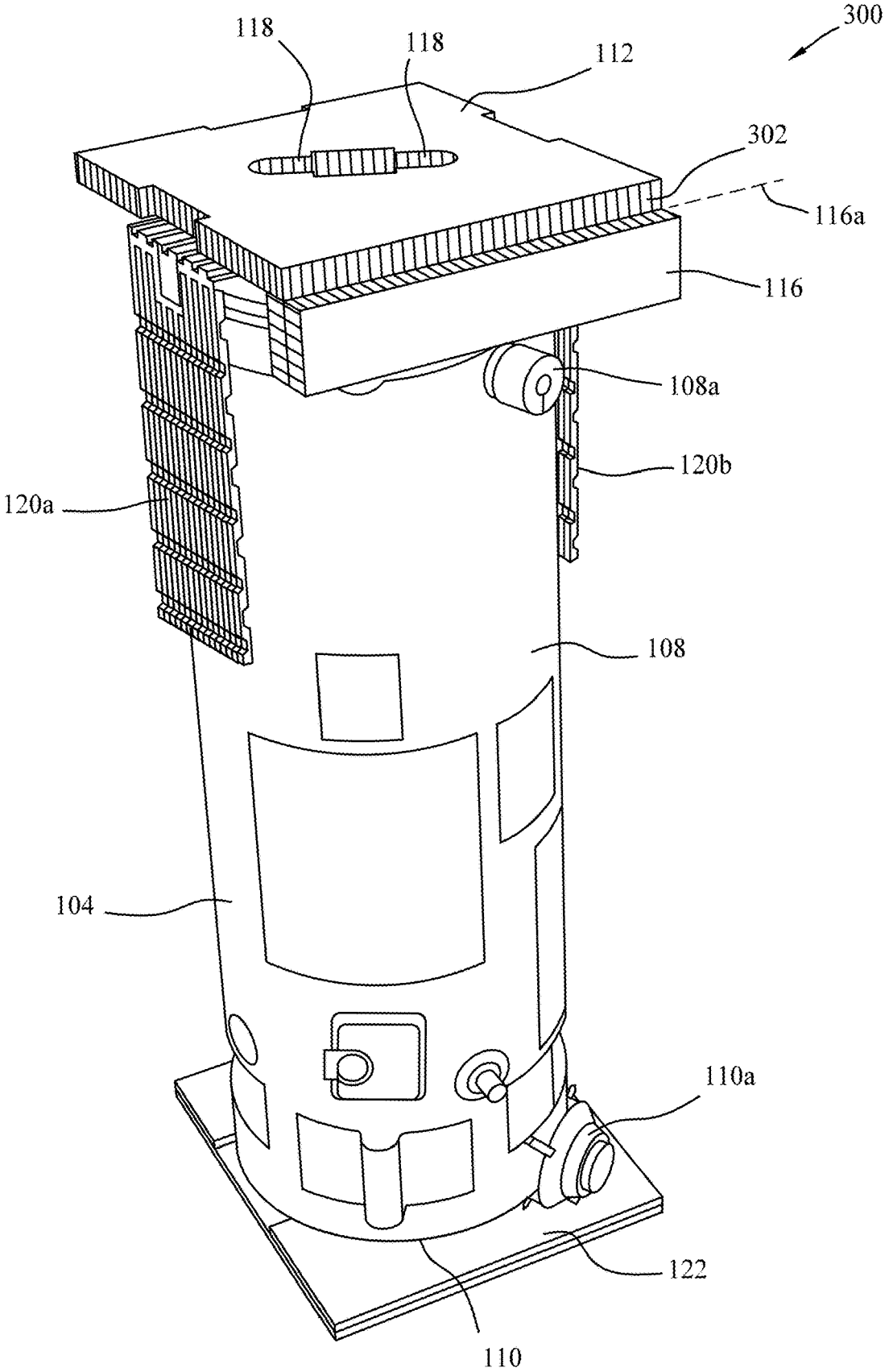
FIGS. 3A-3E illustrate a top insert, according to certain embodiments.

The top insert 112 may be made from recyclable materials such as cardboard (e.g., corrugated or honeycomb cardboard). In some embodiments, the top insert 112 may be formed from corrugated cardboard and placed on top of the top surface 106 of the hot water heater 104 as depicted in FIGS. 1A, 1B, and 1C, or top insert 112 may be formed from honeycomb cardboard as depicted in FIG. 3A. In some embodiments, the top insert 112 may be in a rectangular shape, circular shape, oval shape, or square shape. In FIGS. 1A-1C and FIGS. 3A-3E, the top insert 112 is shown in a rectangular shape, as an example, and may be of any appropriate dimensions and scale in order to adequately contact the top surface 106 of the hot water heater 104 as illustrated in FIGS. 1A-1C and 3A-3D. In some embodiments, top insert 112 may include one or more raised perimeter structures that are predefined to form a shape that matches a shape of the top surface 106 of the hot water heater 104. The one or more raised perimeter structures in the top insert 112 may form a circular shape in order to match a circular shape of the top surface 106 of the hot water heater 104. In some embodiments, the one or more raised perimeter structures forming the shape to match with the shape of the top surface 106 may vary depending on the type of the hot water heater 104 (e.g., gas hot water heater and electric hot water heater).

Figure 3B:
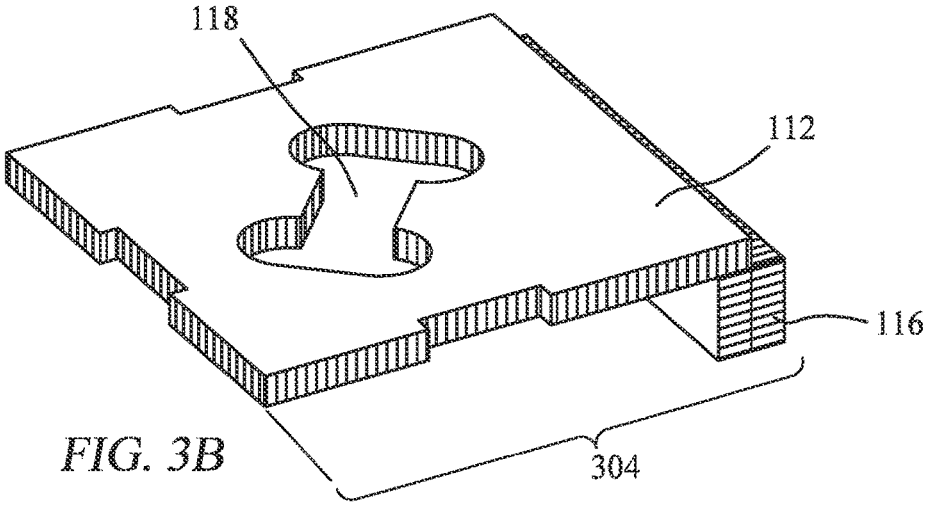
Figure 3C:
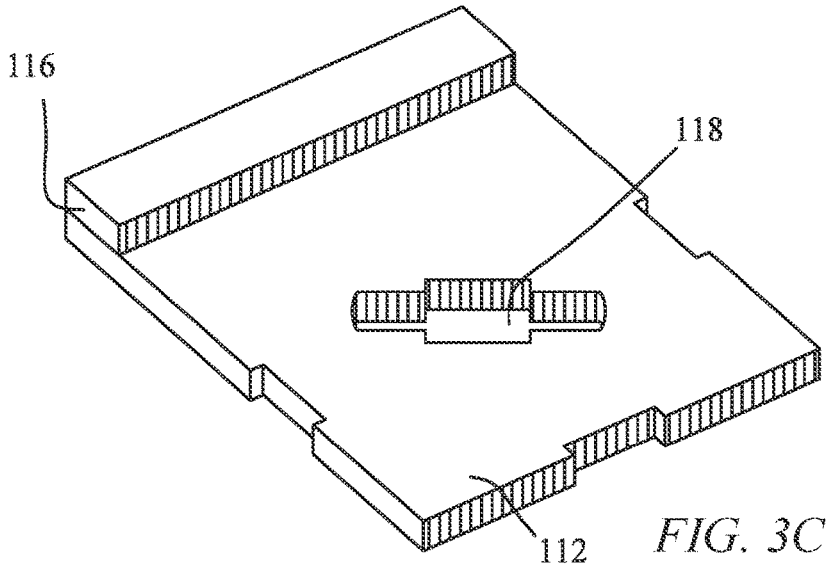
Figure 3D:
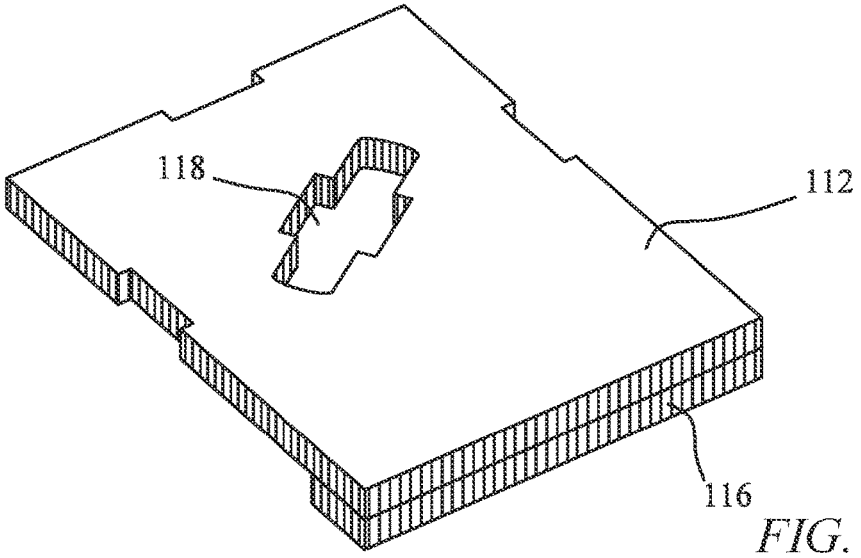
Figure 3E:
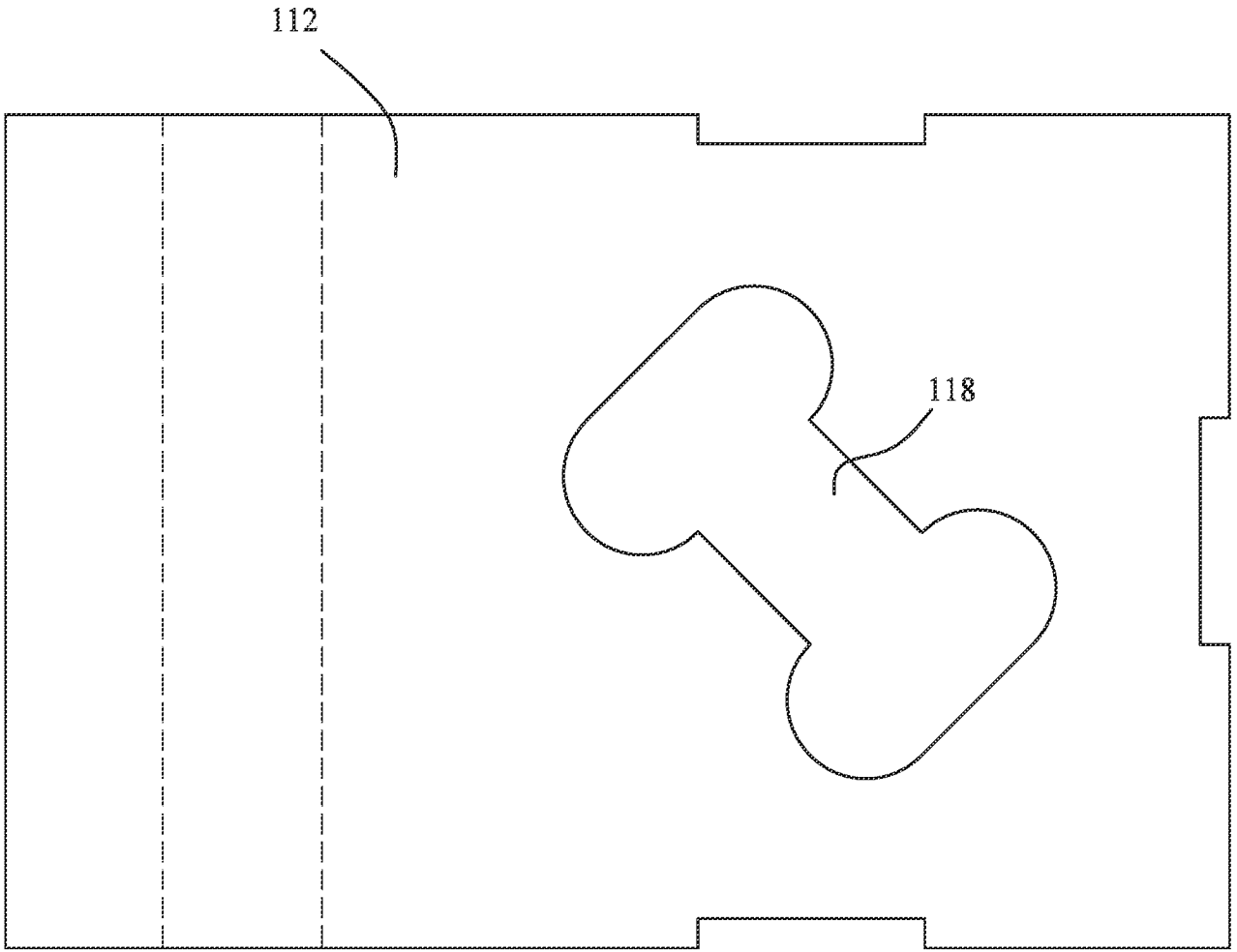

The top insert 112 may be placed to contact the top surface 106 of the hot water heater 104 and a top inside surface 102*a* of the outer box 102 as illustrated in FIGS. 1B and 1C. In some embodiments, the top insert 112 may include a slot 118 that is configured to align with one or more components (e.g., 106*a*, 106*b*, 106*c*) coupled to the top surface 106 of the hot water heater 104, as shown in FIG. 1A. In some embodiments, the slot 118 of the top insert 112 is formed using a punch-cut and crush down process in order to remove portions of the honeycomb cardboard as shown in FIGS. 3B, 3C, 3D, and 3E. FIGS. 3C and 3D illustrate alternate views of FIG. 3B, specifically, 3C shows an inverted view of FIG. 3B and FIG. 3D shows a front view of offset filler 116 of FIG. 3B. FIG. 3E shows top insert 112 with cut-through slot 118 before assembling on the hot water heater 104. The slot 118 may vary in shape, dimensions, and size depending on the one or more components on the top surface 106 of the hot water heater 104 (which in turn may depend on the type of the hot water heater). In embodiments where hot water heater 104 is a gas hot water heater, top insert 112 in combination with slot 118 and offset filler 116 may position and hold hot water heater 104 off-center within outer box 102 to accommodate additional components of the hot water heater 104 (e.g., 110*a*). FIG. 1B shows additional components 106*a*, 106*b*, and 106*c* on the top surface 106 of hot water heater 104 that fit inside slot 118.

Packaging system 100 may include an offset filler 116 that may be made from recyclable materials such as corrugated or honeycomb cardboard. Offset filler 116 may, in some embodiments, be in a rectangular shape and be configured to match certain dimensions of top insert 112. More particularly, offset filler 116 may be coupled to top insert 112 (e.g., using adhesives, tape, and the like) such that offset filler 116 is perpendicular to top insert 112 as illustrated in FIGS. 1A-1B, and FIGS. 3A, 3B, 3C and 3D. As illustrated in FIGS. 1A-1C, offset filler 116 may be formed from corrugated cardboard and then coupled to corrugated patterned top insert 112. In other embodiments, such as illustrated in FIGS. 3A, 3B, 3C and 3D, offset filler 116 may be honeycomb cardboard that is coupled (e.g., using adhesives, tape, and the like) to the honeycomb patterned top insert 112.

Offset filler 116 is configured to be sandwiched between the elongated portion 108 of the hot water heater 104 and the outer box 102 as illustrated in FIGS. 1B and 1C. In general, offset filler 116 fills the space between hot water heater 104 and outer box 102 as illustrated in FIG. 1C. This helps to properly position and secure hot water heater 104 within outer box 102.

In some embodiments, a packaging system 100 includes one or more side panels 102 (e.g., 102*a*, 102*b*, and 102*c*) as illustrated in FIGS. 1A and 3A. In particular embodiments, packaging system 100 includes three side panels 120*a*, 120*b* and 120*c* as illustrated in FIG. 1B. Each side panel 120 may be made from recyclable materials such as corrugated or honeycomb cardboard. Each side panel 120 may be in a rectangular shape. In some embodiments, each side panel 120 may be a molded pulp panel insert that is used with corrugated top insert 112 and honeycomb base insert 122 and functions to provide cushioning and protection to hot water heater 104. The raised panels of side panels 102 offer protection against accidental falls and clamping operations.

FIGS. 4A-40 illustrate various embodiments of a side panel 400 which may be used as side panel 120. In some embodiments, each side panel 400 may include a raised pattern. The raised pattern is depicted as 406*a* and 406*b* in FIGS. 4A-40. The raised patterns 406*a* and 406*b* provide a cushioning effect to the elongated portion 108 of the hot water heater 104 with respect to the outer box 102 during an impact or fall. Raised patterns 406*a* and 406*b* may be any appropriate shape or pattern. In some embodiments, raised patterns 406*a* and 406*b* are rectangular-shaped or square-shaped raised elements that are arranged in an array as illustrated in FIGS. 4A-40.

Each side panel 400 may be an L-shape side panel (e.g., two rectangular portions 402 and 406 that are generally perpendicular to each other). Each side panel 400 may include a short portion 402 and a long portion 404. In some embodiments, short portion 402 includes raised pattern 406*b* and long portion 404 includes raised pattern 406*a*. In some embodiments, the short portion 402 may be separated from the long portion 404 through a pre-folded cut or partial cut depicted as 400*a* (e.g., cut to a certain depth) that permits easy folding of short portion 402 or long portion 404 into an L-shaped side panel 400. In other embodiments, short portion 402 is affixed perpendicular to long portion 404 (e.g., using adhesive and the like) along line 400*a*. In general, short portion 402 is configured to contact top surface 106 of hot water heater 104 and long portion 404 is configured to contact elongated portion 108 of hot water heater 104.

In some embodiments, short portion 402 may be inserted between top insert 112 and top surface 106 of hot water heater 104. Long portion 404 may be sandwiched between elongated portion 108 of hot water heater 104 and outer box 102. Short portion 402 holds the side panel 400 in place within outer box 102 and allows long portion 404 of side panel 400 to hang down one side of hot water heater 104 in order to provide cushioning during an impact as illustrated in FIGS. 1A-1C.

In some embodiments, each side panel 400 may include a cutout 408 configured to align with one or more components coupled to elongated portion 108 of hot water heater 104 (e.g., component 108*a* in FIG. 1B). Cutout 408 may be in the shape of a square, rectangle, circle, or any other appropriate shape. Cutout 408 may be in any appropriate location on side panel 400. In some embodiments, side panel 400 may include multiple cutouts 408.

Figure 4A:
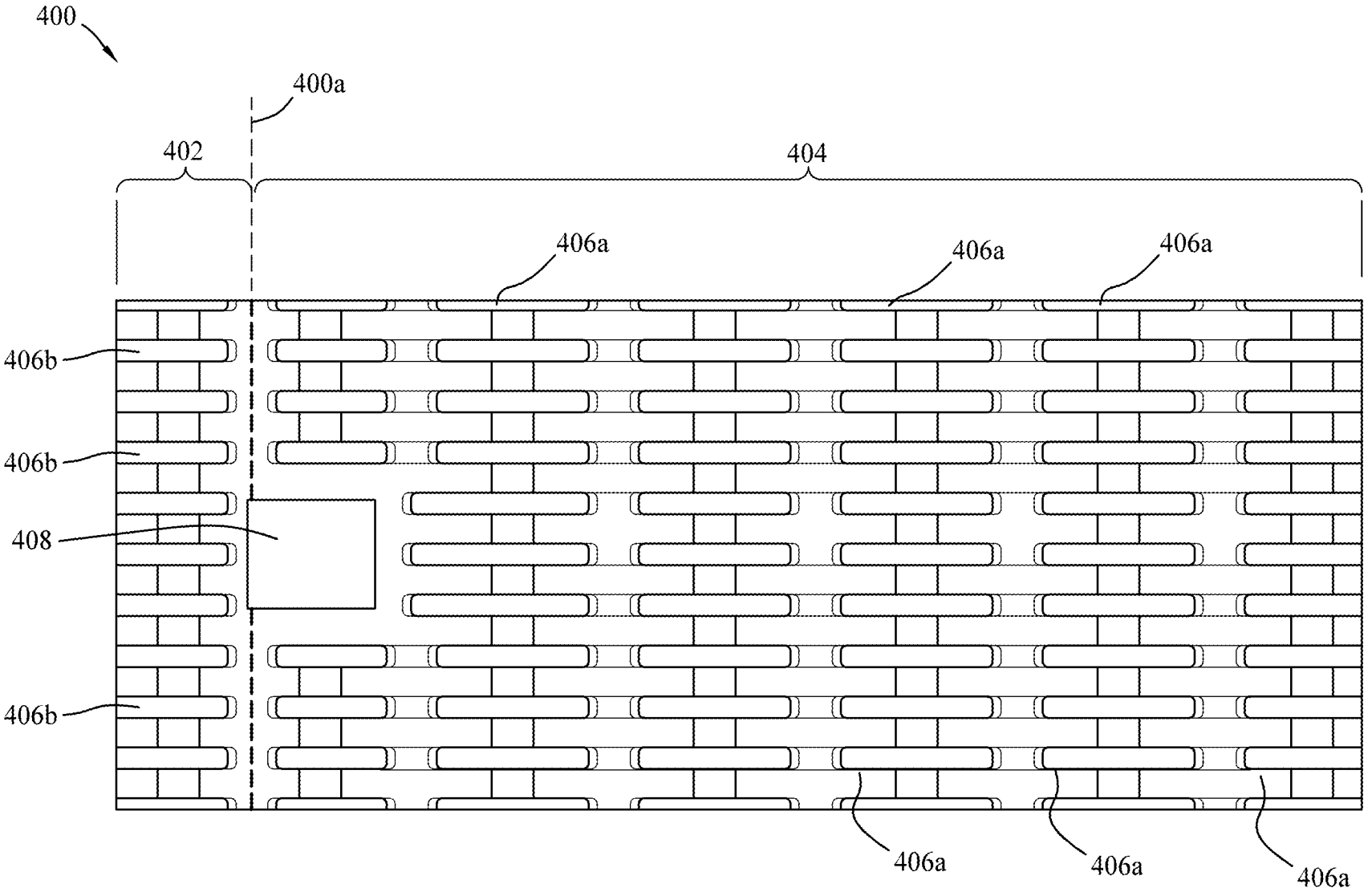
Figure 4B:
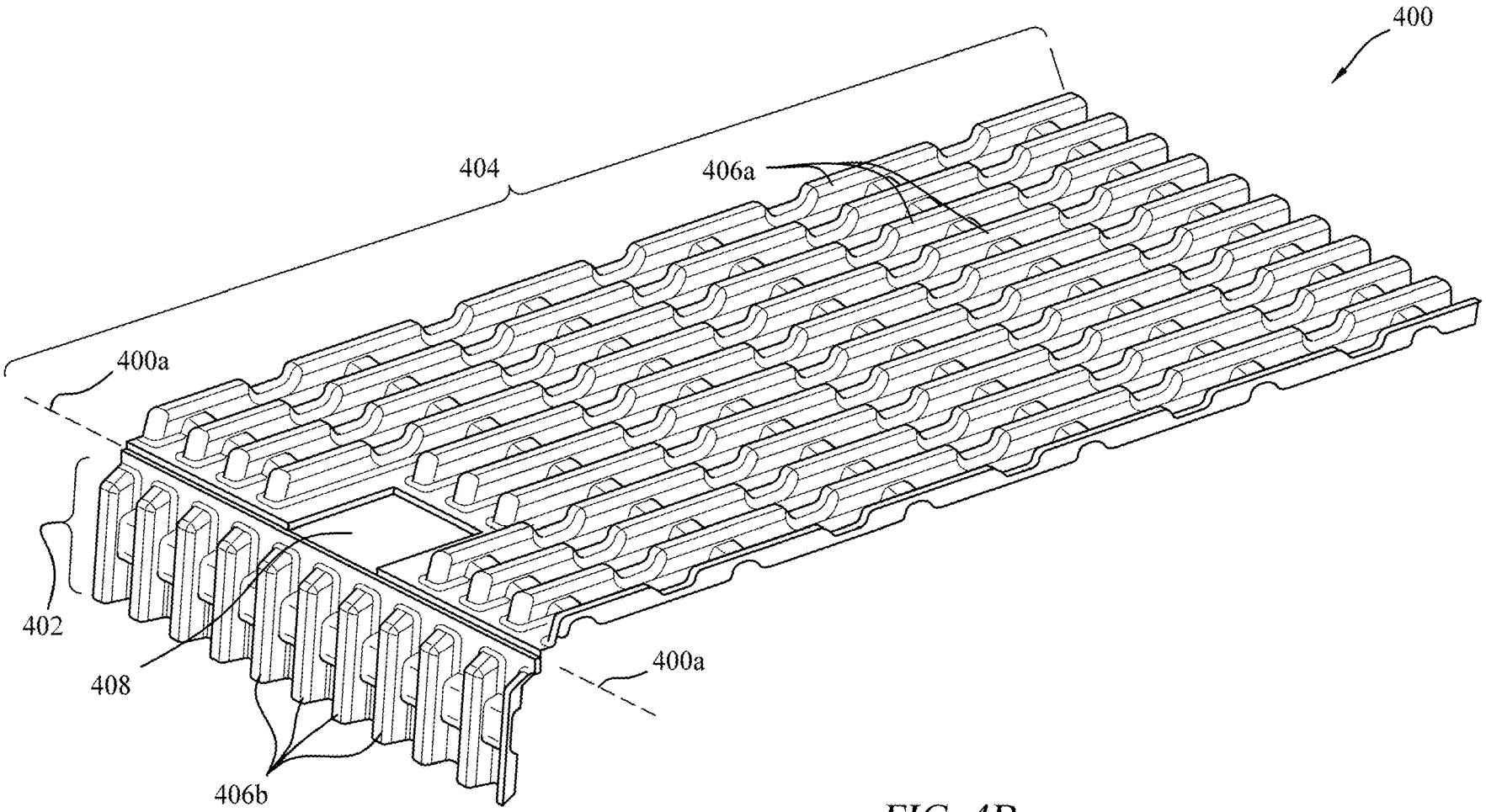
Figure 4C:
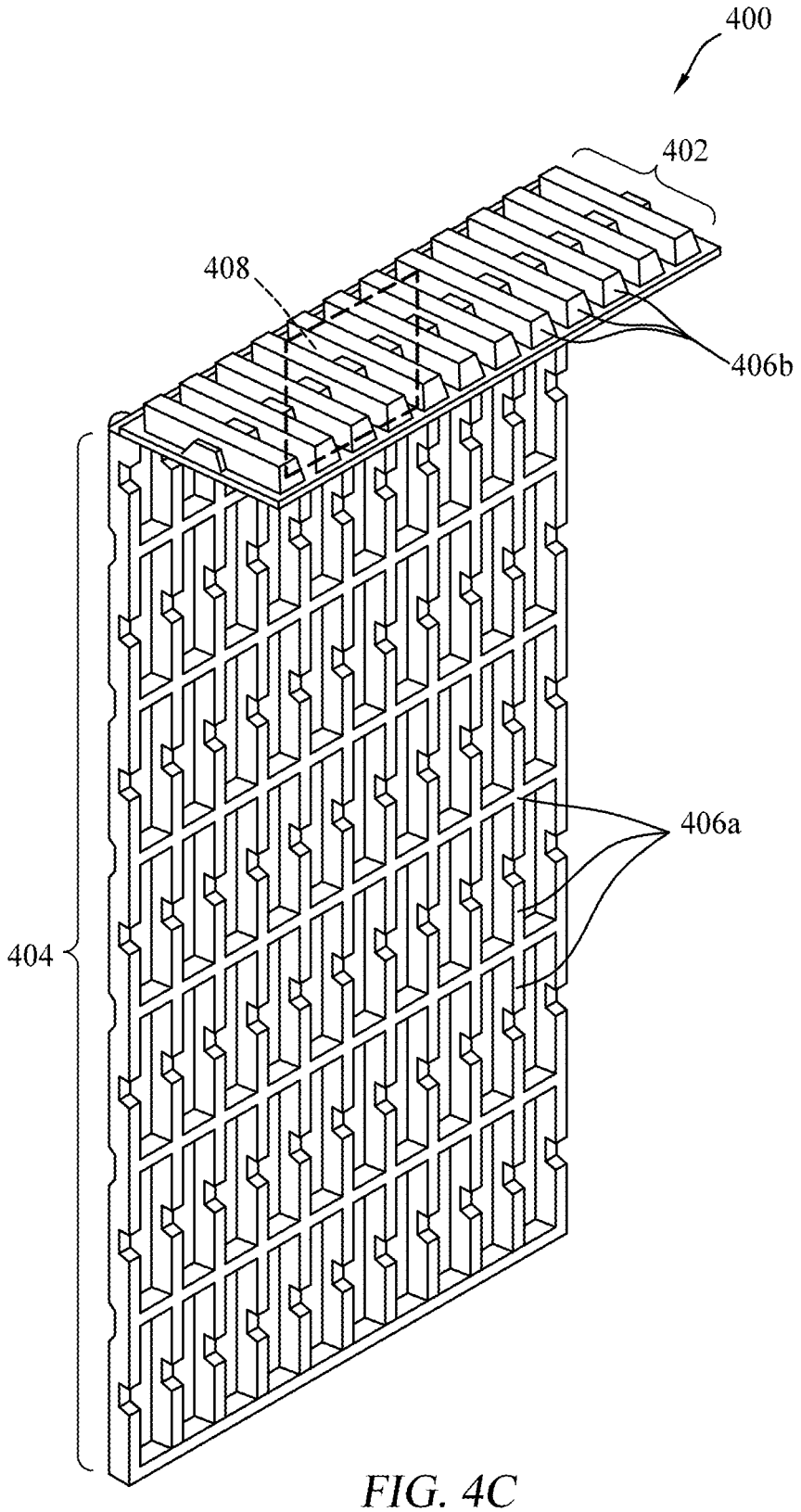
Figure 4E:
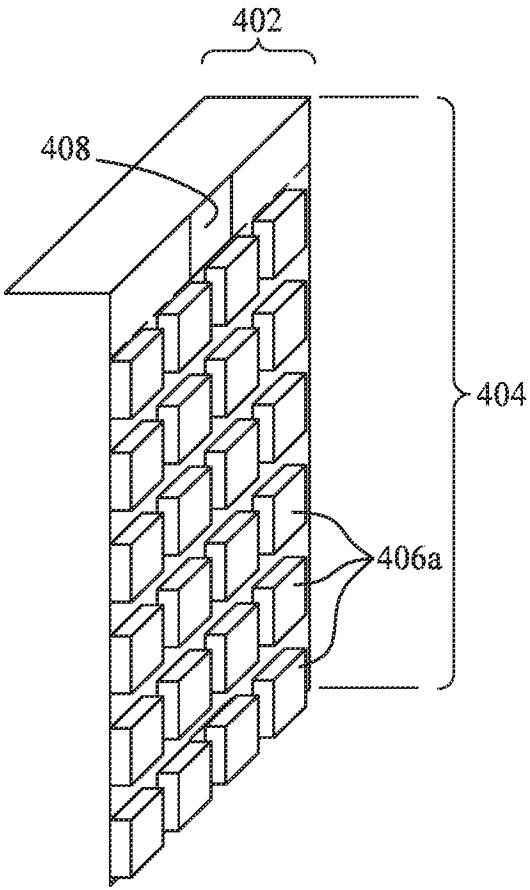
Figure 4D:
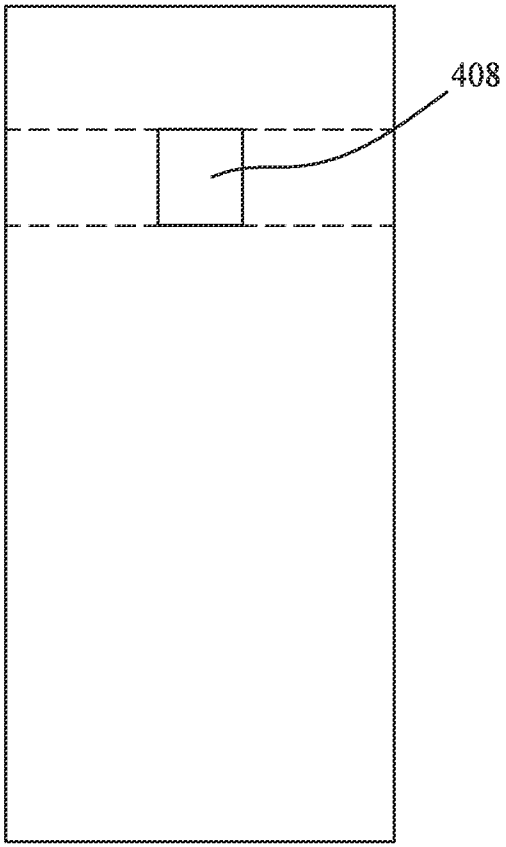
Figure 4H:
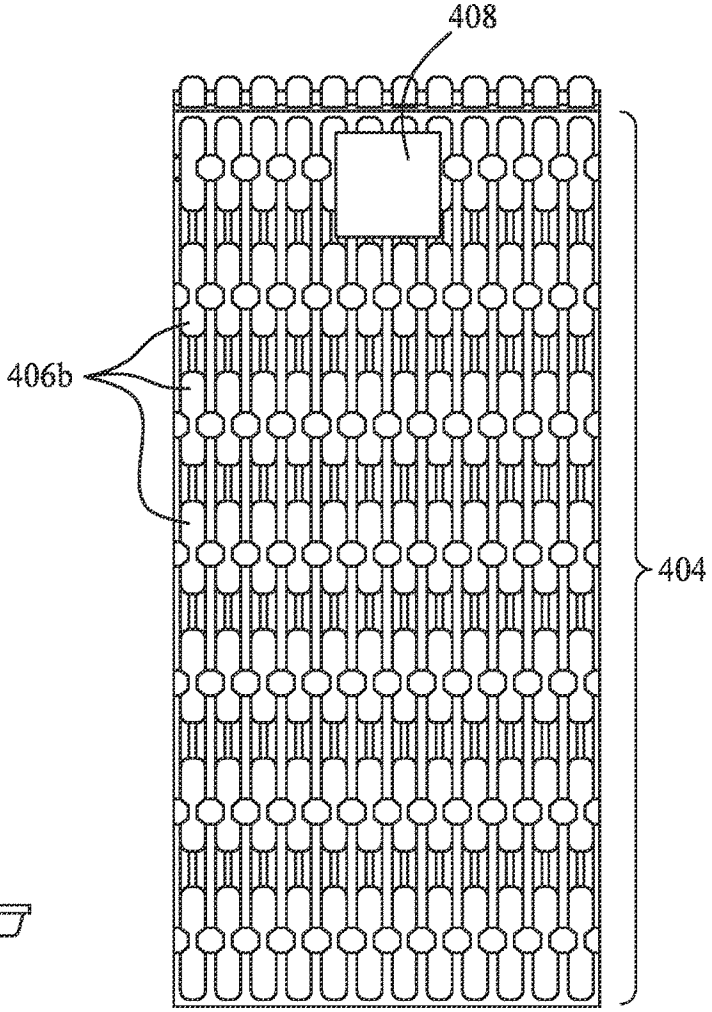
Figure 4F:
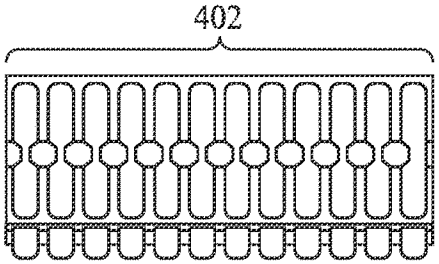
Figure 4G:
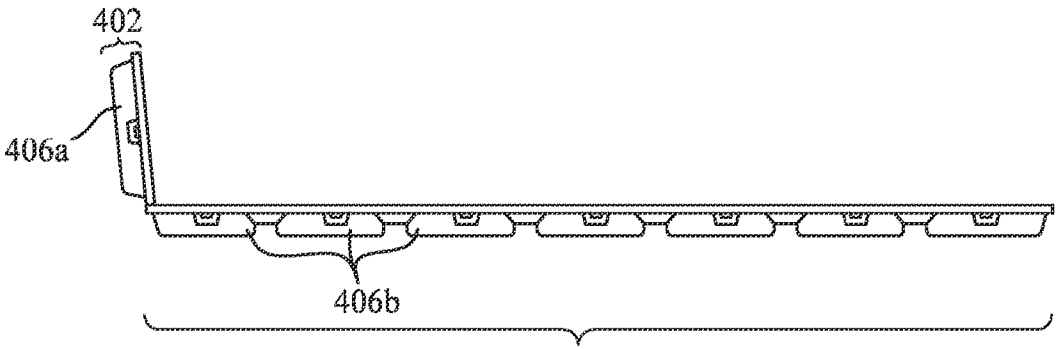
Figure 4I:
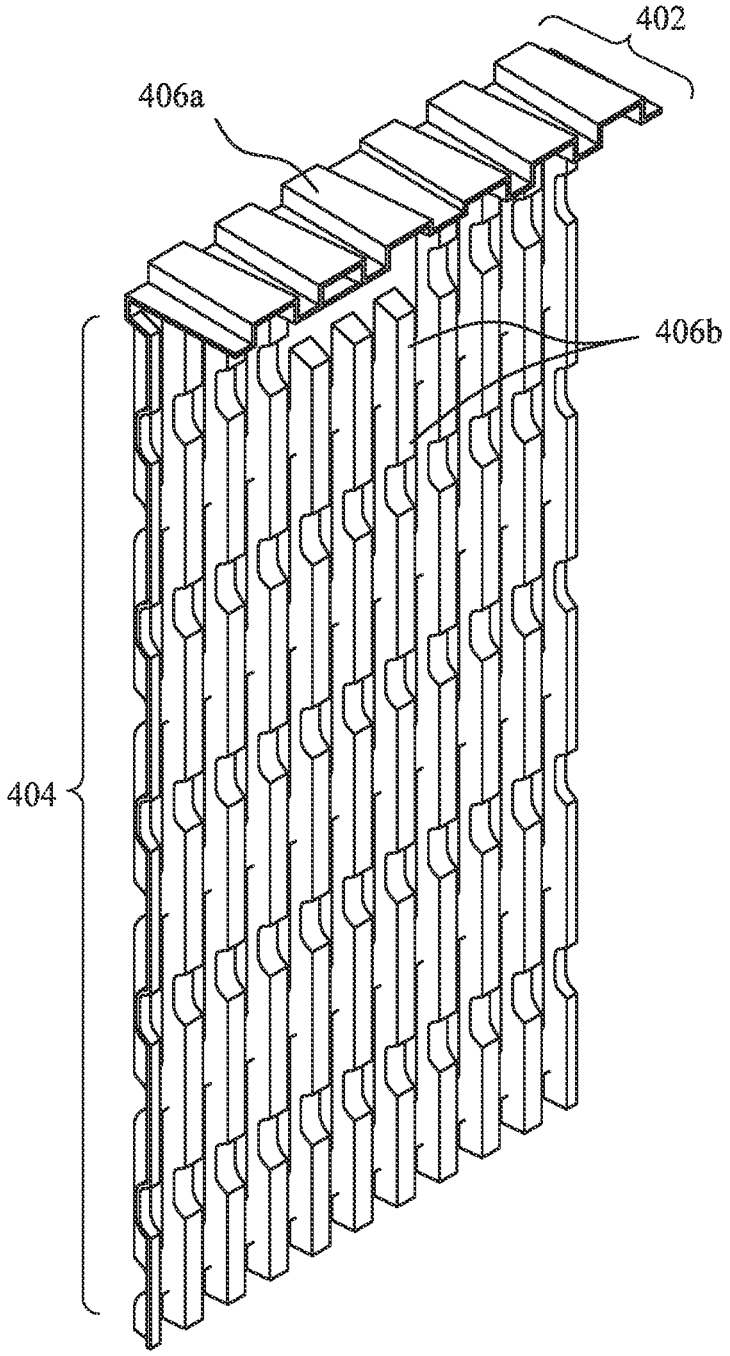
Figure 4J:
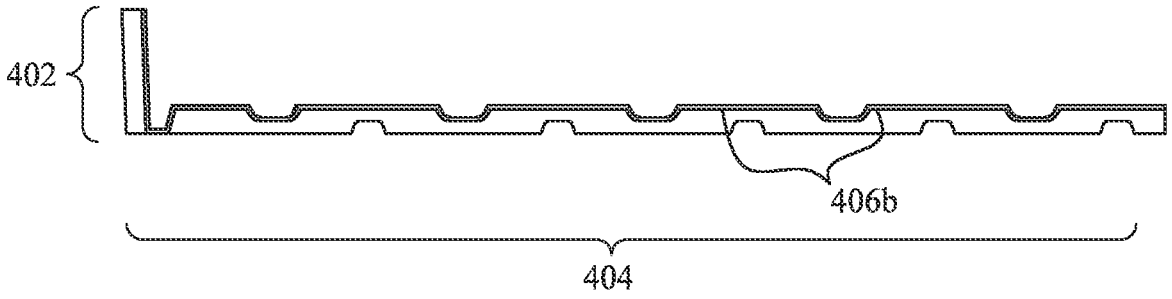
Figure 4K:
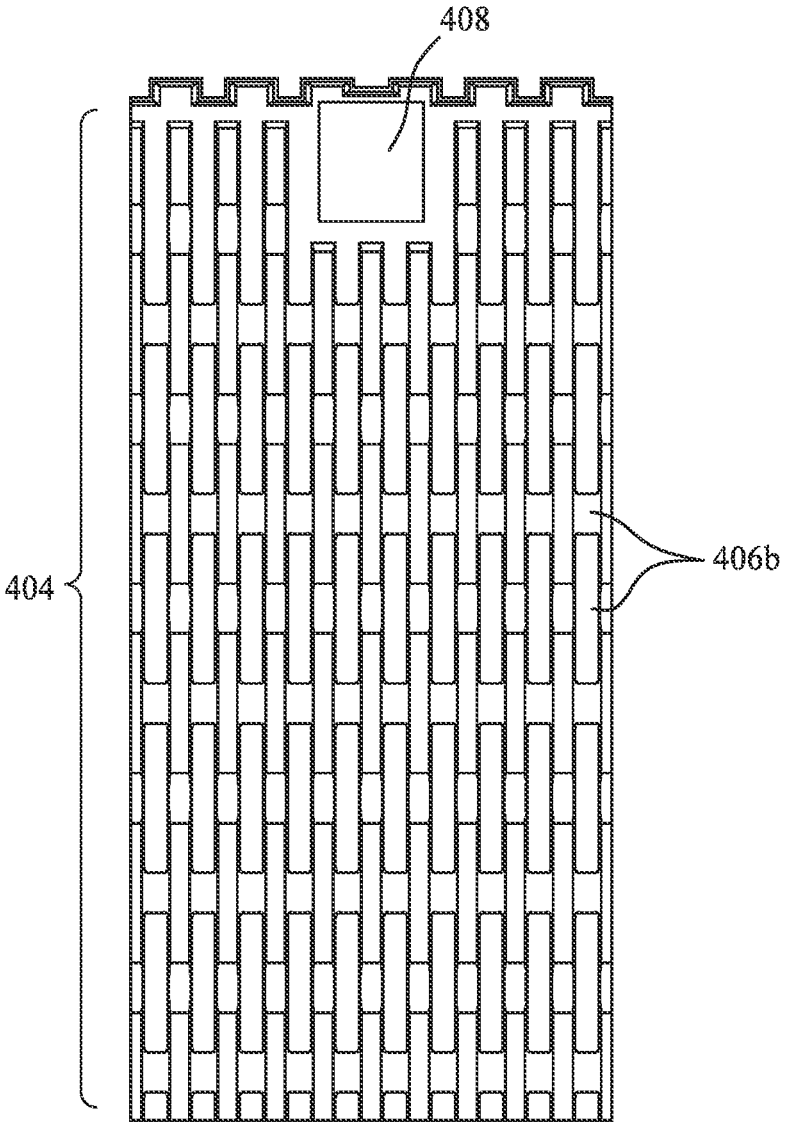
Figure 4L:
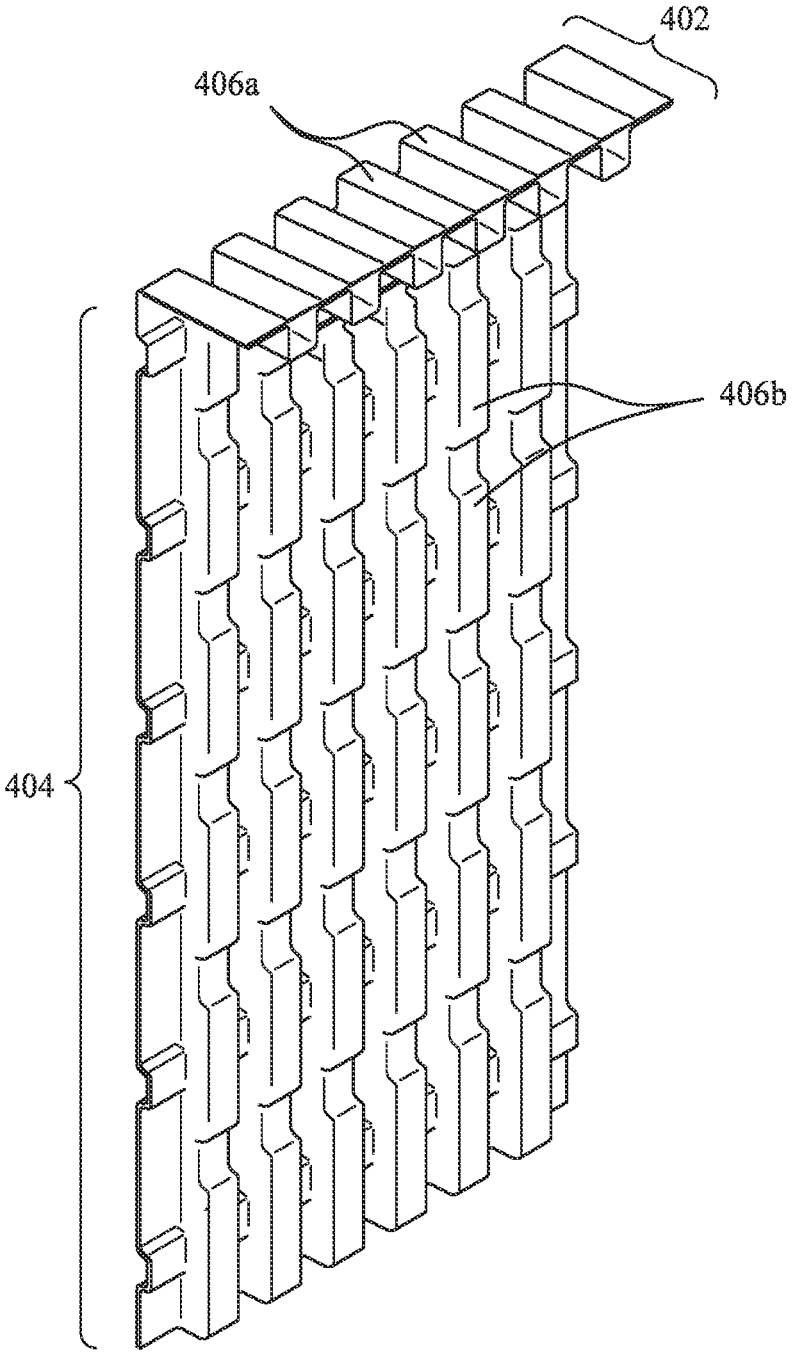
Figure 4M:
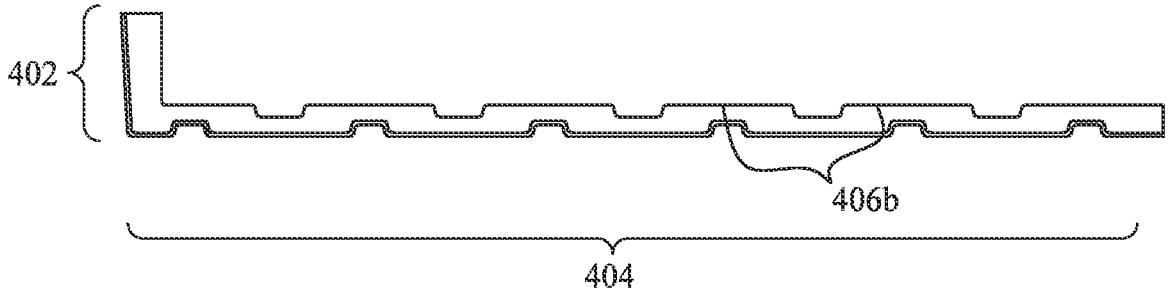
Figure 4N:
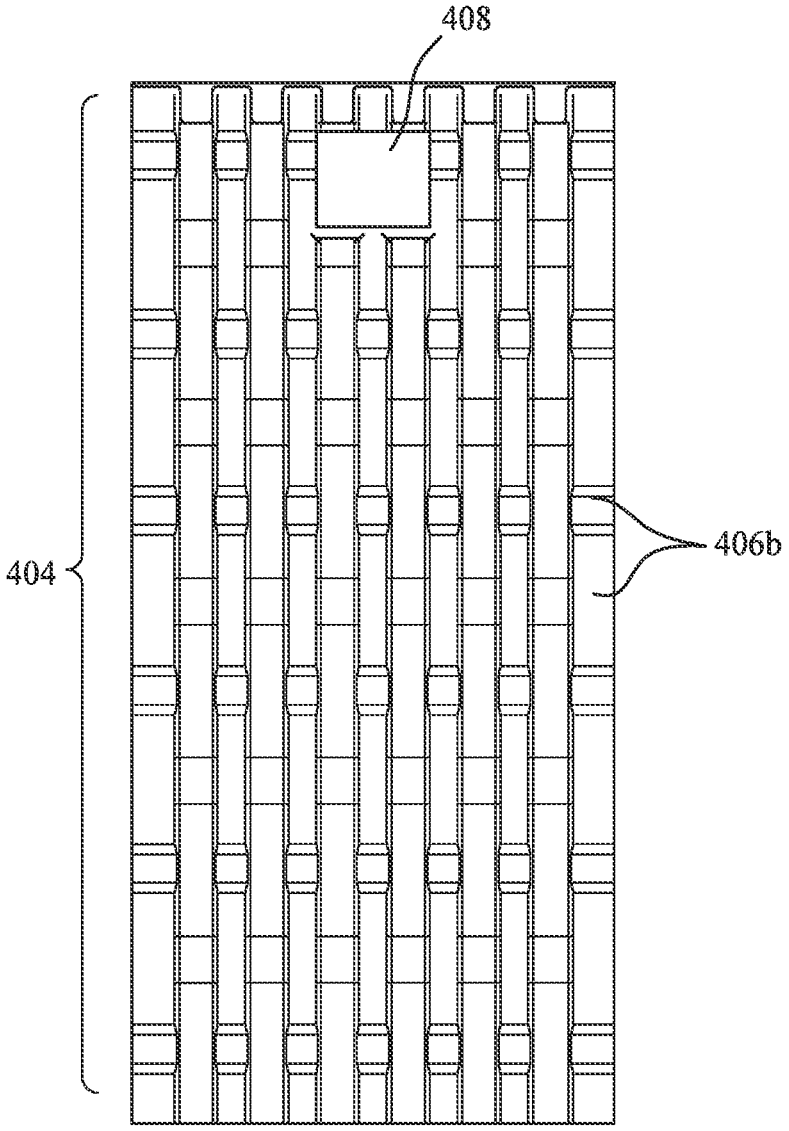
Figure 4O:
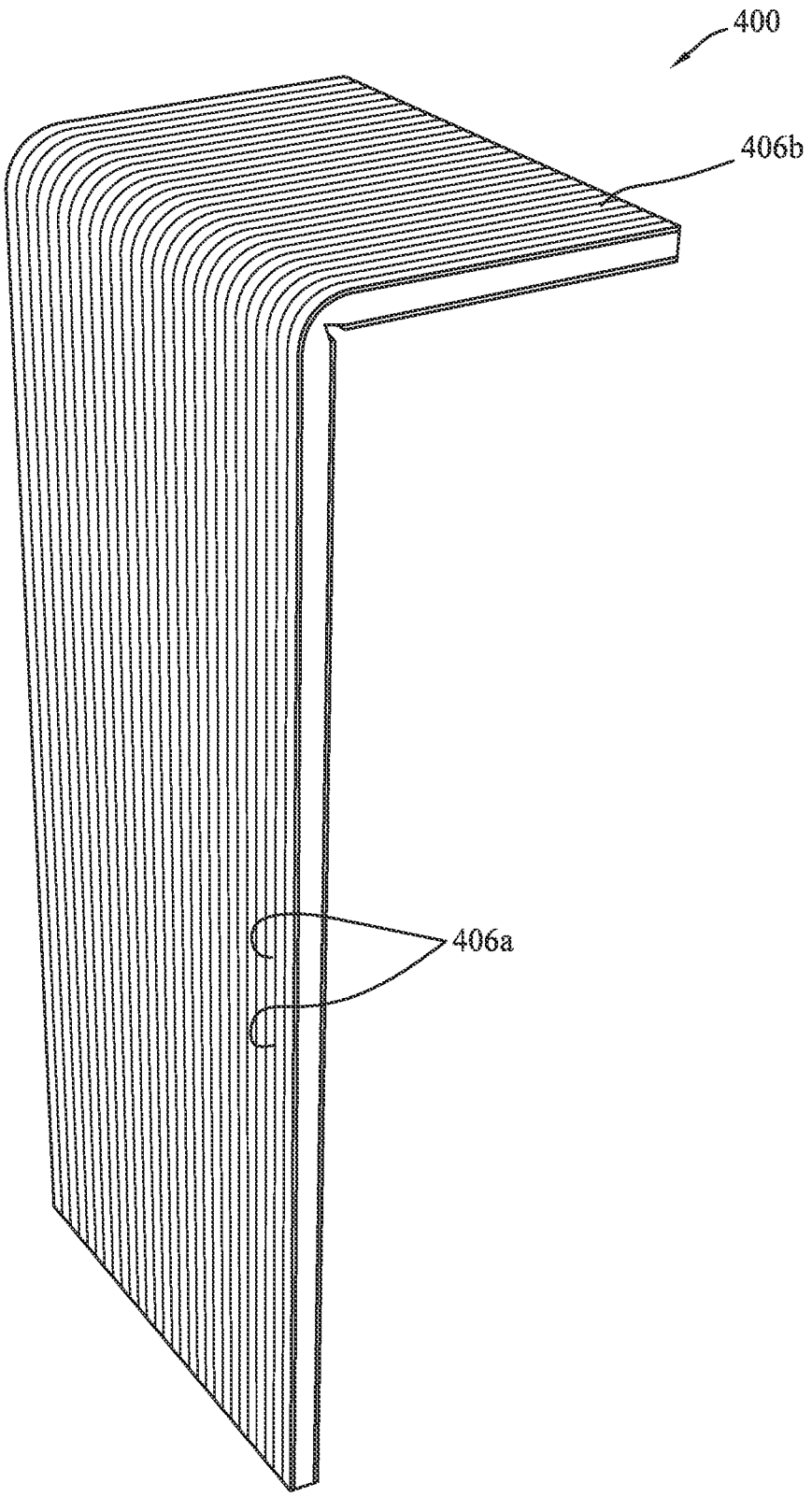
Figure 5A:
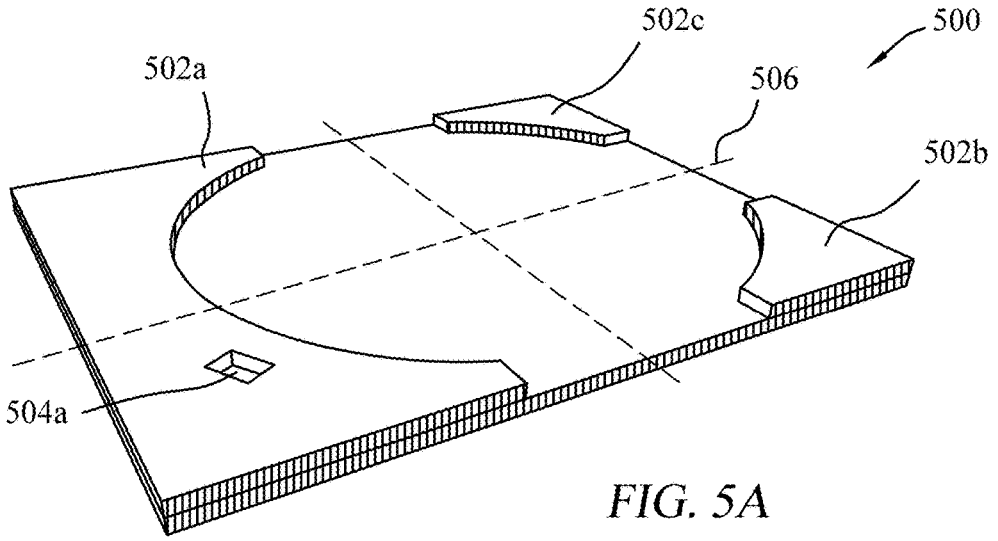
FIGS. 5A-5C illustrate a base insert, according to certain embodiments.
Figure 5B:
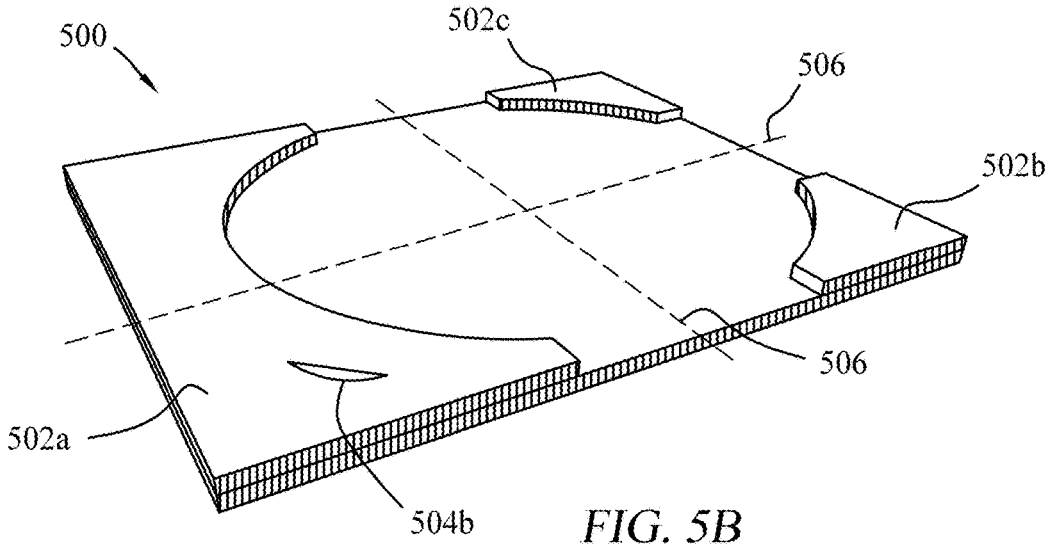
Figure 5C:
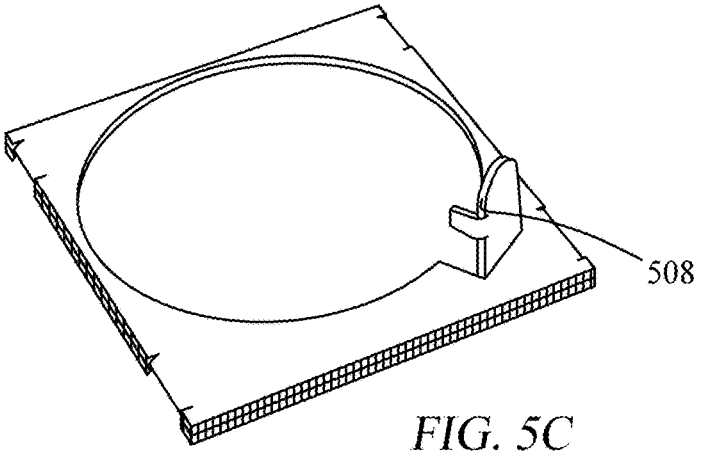

Referring to FIGS. 4D and 4E, certain embodiments of side panel 400 may include a short portion 402 without any raised patterns and a long portion 404 that includes raised pattern 406*a* along with a cutout 408. FIGS. 4F-4N show different views of side panel 400. In each FIG. 4F-4N, the short portion 402 includes raised pattern 406*a* and long portion 404 includes raised pattern 406*b* along with a cutout 408. As an example, FIGS. 4I-4N show pulp raised pattern 406*a* on short portion 402 and 406*b* on long portion 406*b*. FIG. 40 illustrates an alternate side panel 400 for packaging system 100. Side panel 400 of FIG. 40 is formed of a single piece of cardboard with continuous ridges that is formed (e.g., by folding) into an L shape.

FIGS. 5A-5C illustrate a base insert 500 that may be used as base insert 122 in packaging system 100. Base insert 500 may be made from recyclable materials such as honeycomb cardboard as illustrated in FIGS. 5A and 5B and/or corrugated cardboard as illustrated in FIG. 5C. In general, base insert 500 provides a cushioned base for bottom surface 110 of hot water heater 104 and functions to align hot water heater 104 within outer box 102. For example, corrugated base insert 500 of FIG. 5C includes a raised edge 508 to help keep hot water heater 104 in place within outer box 102. In some embodiments, base insert 500 may include raised features in a circular shape or an oval shape to match the shape of bottom surface 110 of hot water heater 104. In particular, base insert 500 may include one or more raised perimeter structures 502 (e.g., 502*a*, 502*b*, and 502*c*) that are predefined to form a shape that matches a shape of the bottom surface 110 of hot water heater 104. In some embodiments, perimeter structures 502 may form a circular shape to match a circular shape of the bottom surface 110 of hot water heater 104. For example, a gas hot water heater 104 may have a circular bottom surface 110 and the raised perimeter structures 502 may together form some or all of a circle shape to match with the circular shape of the bottom surface 110 of the gas hot water heater 104. In some embodiments, the one or more raised perimeter structures 502 are configured to position the hot water heater 104 off-center with respect to a center axis depicted as the intersection of dashed lines 506 of outer box 102. In some embodiments, the one or more raised perimeter structures 502 form a shape to match with the shape of the bottom surface 110. The shape formed by raised perimeter structures 502 may vary depending on the type of the hot water heater 104 (e.g., a gas hot water heater or an electric hot water heater).

The base insert 122 may be placed to contact the bottom surface 110 of the hot water heater 104 and a bottom inside surface 102*b* of the outer box 102 as shown and illustrated in FIGS. 1B and 1C. In some embodiments, the base insert 122 may include an aperture 504*a* that may be configured to align with a component on or proximate to the bottom surface 110 of the hot water heater 104. For example, in FIGS. 1A-1C, the component 110*a* proximate to the bottom surface 110 may be configured to be placed in the aperture 124 as shown in FIGS. 1A-1C and in the aperture 504*a* as shown in FIG. 5A. In some embodiments, aperture 504*a* may be of any shape and dimensions that may be configured according to the component to align with on the bottom surface 110 of the hot water heater 104, which in turn may depend upon the type of the hot water heater (e.g., gas or electric hot water heater).

Referring to FIGS. 1B and 1C, packaging system 100 may further include one or more pads 126*a* and 126*b*. Pad 126*a* may be a top pad 126*a* that may be placed between the top insert 112 and the top inside surface 102*a* of the outer box 102, as illustrated in FIG. 1C. Pad 126*b* may be a bottom pad 126*b* that may be placed between the base insert 122 and the bottom inside surface 102*b* of the outer box 102, as illustrated in FIGS. 1B and 1C.

FIGS. 6A-6D illustrate a packaging system 600 for an electric hot water heater 602. Electric hot water heater 602 includes a top surface 604, a bottom surface 606, and an elongated portion 608. Like packaging system 100, packaging system 600 includes a top insert 610 and a base insert 614. However, packaging system 600 includes a center collar 612 instead of or in addition to side panels 120.

Figure 7A:
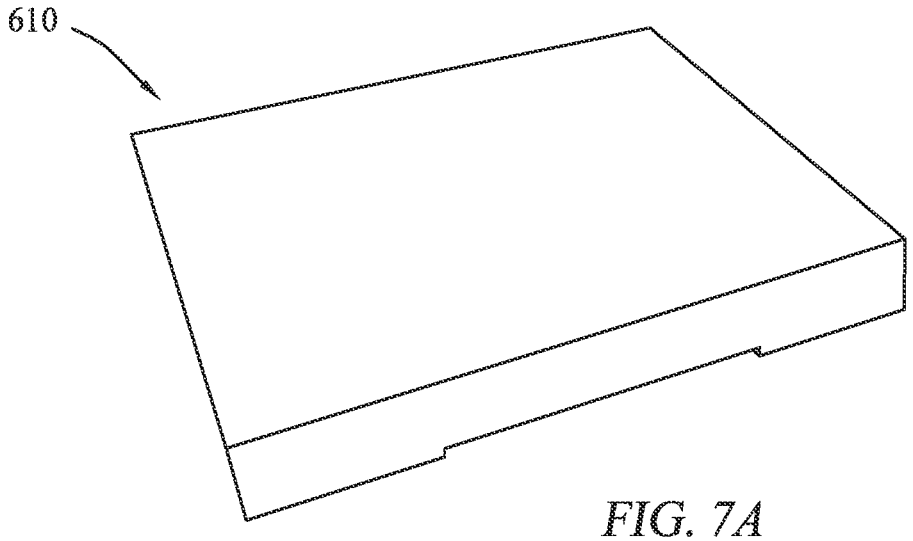
FIGS. 7A-7D illustrate a top insert and base insert for an electric hot water heater, according to certain embodiments.
Figure 7B:
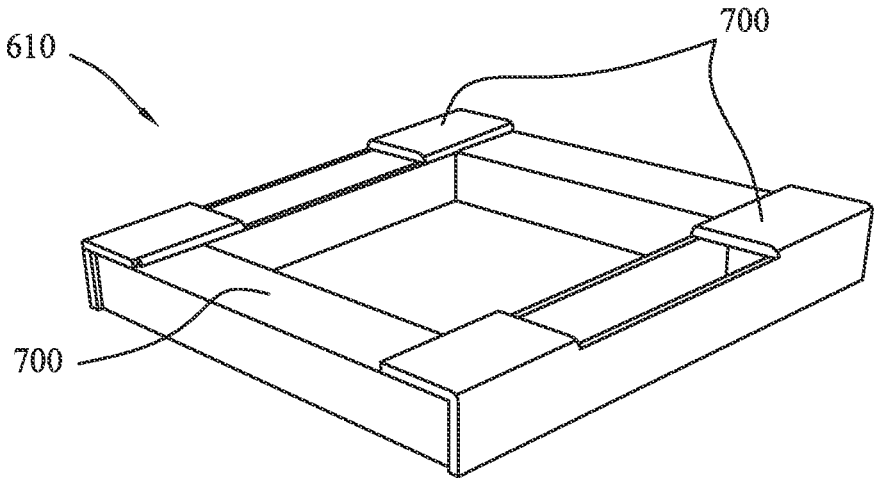
Figure 7C:
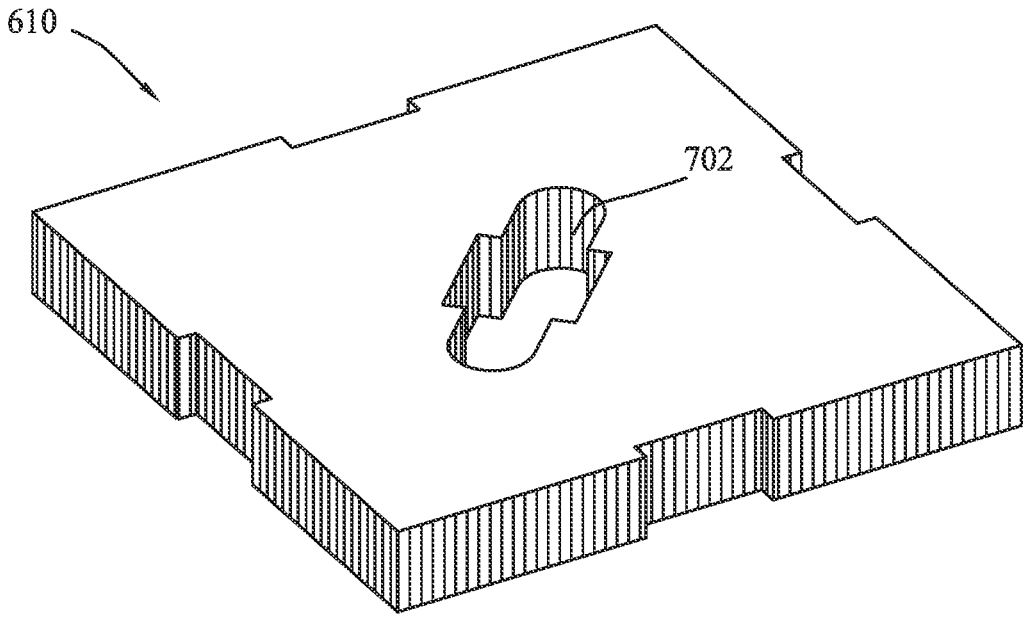

Referring to FIGS. 7A and 7B, FIG. 7A shows a top view of the top insert 610 and FIG. 7B shows an inverted or upturned view of the top insert 610 with respect to FIG. 7A. The top insert 610 may include one or more raised perimeter structures depicted as 700. The one or more raised perimeter structures may be configured to form a shape that matches a shape of the top surface 604 of electric hot water heater 602. In some embodiments, the top insert 610 may be formed from honeycomb cardboard as illustrated in FIG. 7C. The top insert 610 may include a slot 702 that is configurable to align with a component (e.g., valves, pins, and the like) on the top surface 604 of the hot water heater 602.

Figure 6A:
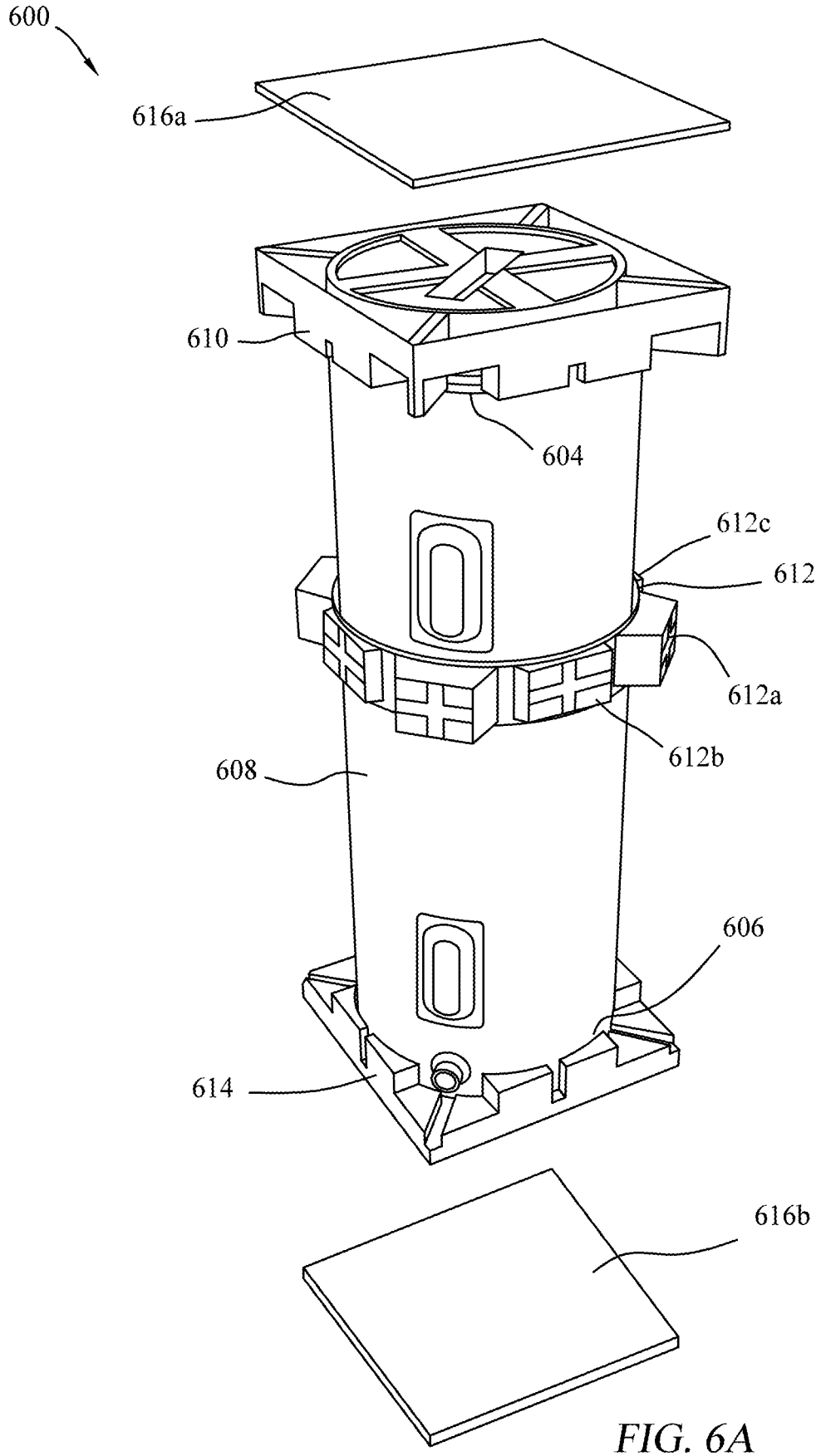
FIGS. 6A-6D illustrate an electric hot water heater packaging system, according to certain embodiments.
Figure 6B:
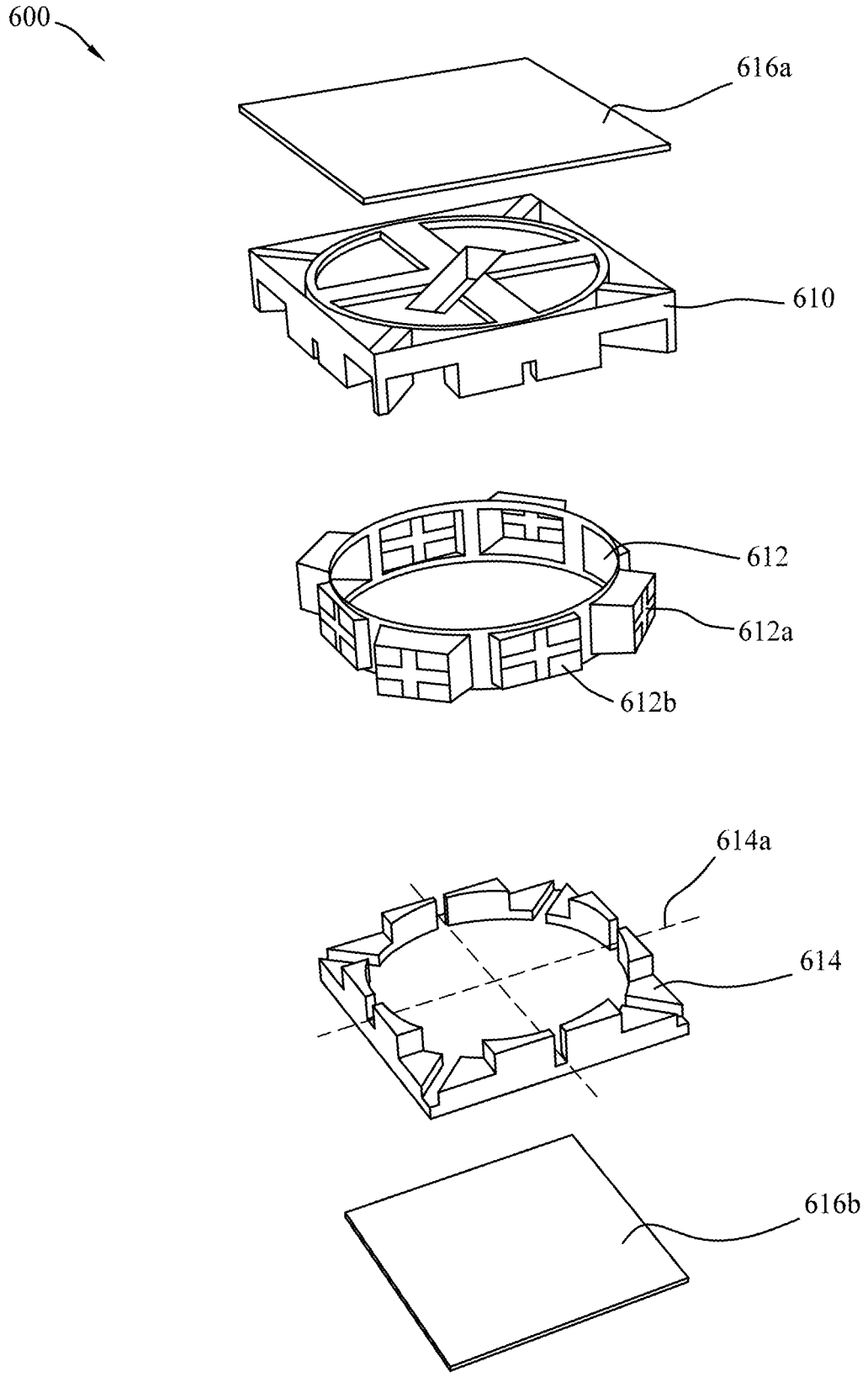
Figure 6C:
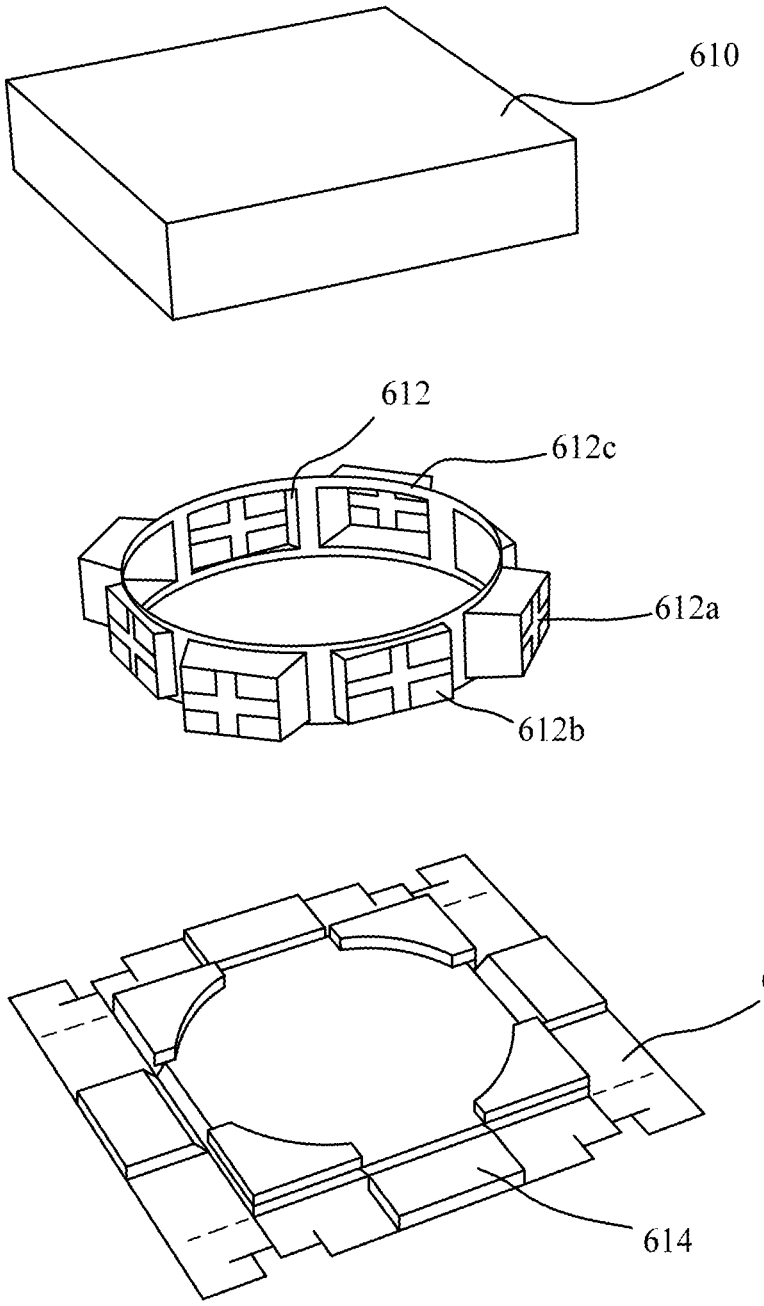
Figure 6D:
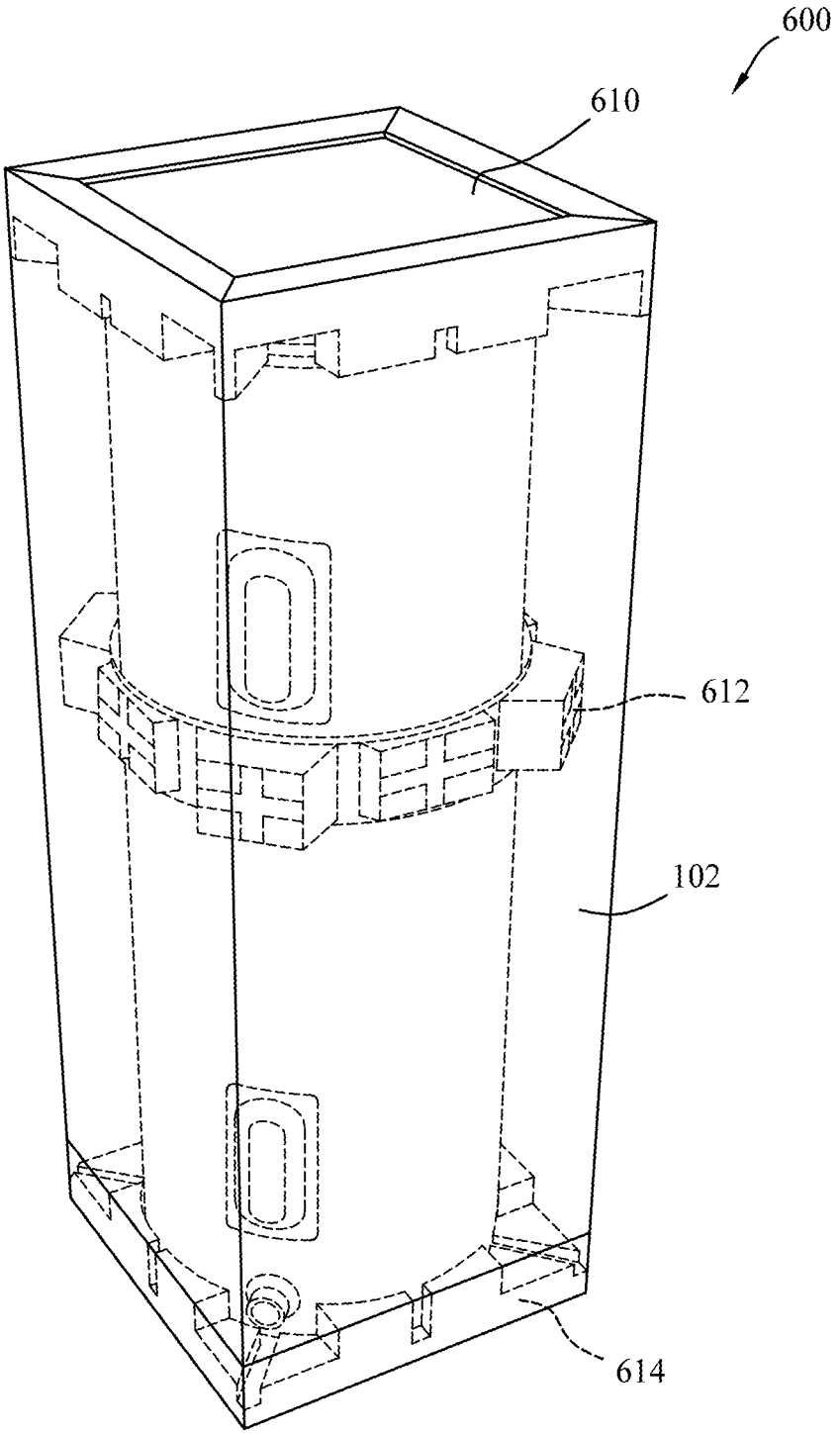
Figure 7D:
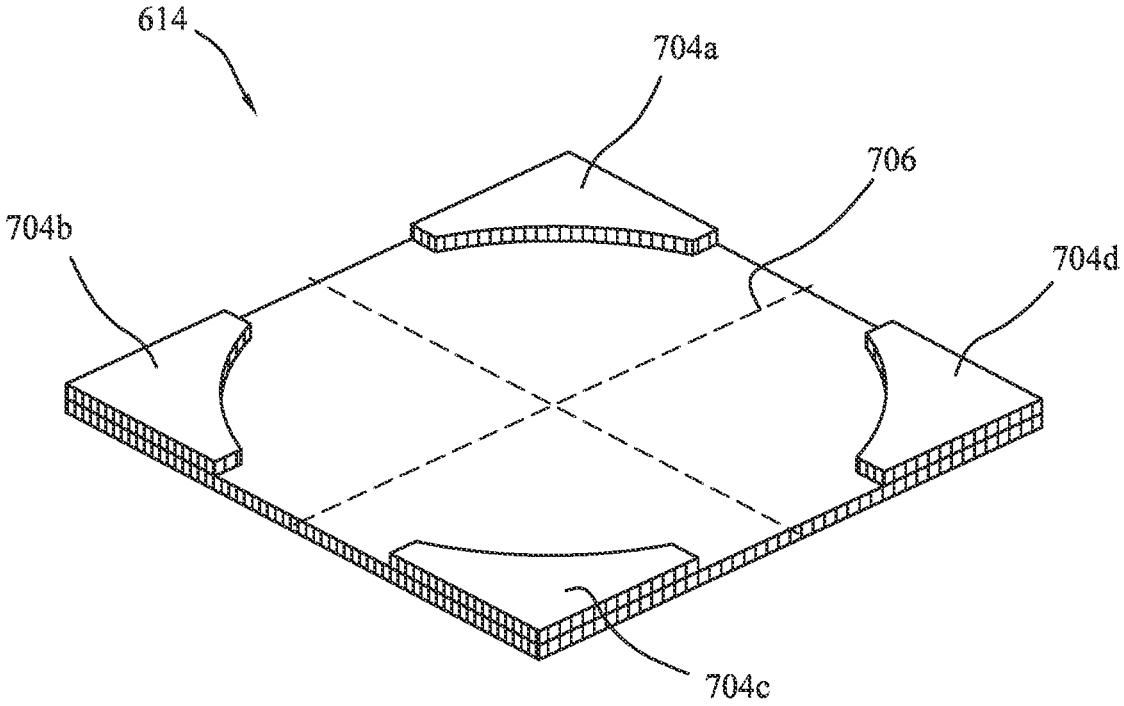

Base insert 614 may be formed from honeycomb or corrugated cardboard and may include one or more second raised perimeter structures 704 (i.e., 704*a*-704*d*) as illustrated in FIG. 7D. The second perimeter structures 704 form a shape that matches a shape of the bottom surface 614 of the hot water heater 602. The shape formed by second raised perimeter structures 704 may be square or a circle for electric hot water heater 602. FIGS. 6A-6E and 7D show second raised perimeter structures 704 to be a circular shape. In some embodiments, one or more second raised perimeter structures 704 are configured to position the hot water heater 602 centered about a center axis depicted as the intersection of lines 706.

Referring to FIG. 6A, packaging system 600 may further include a center collar 612. The center collar 612 may be coupled around a mid-portion of the elongated portion 608 of the hot water heater 602 and may include one or more raised patterns 612*a*-612*c*. The one or more raised patterns 612*a*-612*c* of center collar 612 are configured to contact the outer box 102. Packaging system 600 may use center collar 612 in place of side panels 112 or, in some embodiments, may use center collar 612 in addition to side panels 112.

FIG. 6B illustrates a molded pulp top insert 610, base insert 614 and center collar 612. The center collar 612 functions as a clamping support, along with damage prevention from accidental falls. The base insert 614 may be elevated to protect portions of electric hot water heater 602 (e.g., venting areas) and may function to stabilize electric hot water heater 602 within outer box 102. In some embodiments, outer box 102 features a zipper rule for easy opening.

In some embodiments, packaging system 600 may include a top pad 616*a* and a bottom pad 616*b*, which may be identical to one another. The top pad 616*a* may be configured to be placed between the top insert 610 and the top inside surface 102*a* of the outer box 102. The bottom pad 616*b* may be configured to be placed between the base insert 614 and the bottom inside surface 102*b* of the outer box 102.

FIG. 6C illustrates a molded pulp center collar 612, a honeycomb top insert 610, and a honeycomb base insert 614. The molded pulp center collar 612 may function as a clamping support, along with damage prevention from accidental falls. This embodiment offers a self-locking feature for the top insert 112 and base insert 122 by aligning with components of top surface 106 and bottom surface 110 of hot water heater 104 once assembled and ready for containing in the outer box 102 placement. Base insert 614 may include trays 618 that provide a surface for a flanged tube glue operation. In some embodiments, base insert 614 has panels that serve as vent protection and kicking resistance.

FIG. 6D illustrates an assembled version of the packaging system 600 in the outer box 102.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, functions, operations, or steps, any of these embodiments may include any combination or permutation of any of the components, elements, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A packaging system for a hot water heater, the packaging system comprising:

an outer box configured to contain the hot water heater that comprises a top surface, a bottom surface, and an elongated portion;

a top insert configured to contact the top surface of the hot water heater and a top inside surface of the outer box, the top insert comprising a slot configured to align with a component on the top surface of the hot water heater;

an offset filler coupled to the top insert, the offset filler configured to be sandwiched between the elongated portion of the hot water heater and the outer box;

a base insert configured to contact the bottom surface of the hot water heater and a bottom inside surface of the outer box, the base insert comprising one or more raised perimeter structures configured to form a shape that matches a shape of the bottom surface of the hot water heater, wherein the one or more raised perimeter structures and the offset filler are configured to position the hot water heater off-center with respect to a center axis of the outer box; and one or more side panels, each side panel comprising:

a raised pattern; and an L-shape that comprises a short portion and a long portion, wherein the short portion is configured to be inserted between the top insert and the top surface of the hot water heater, and wherein the long portion is configured to be sandwiched between the elongated portion of the hot water heater and the outer box.

2. The packaging system of claim 1, wherein the hot water heater is a gas hot water heater.

3. The packaging system of claim 1, wherein the top insert comprises a predefined perimeter structure to form a shape that matches a shape of the top surface of the hot water heater.

4. The packaging system of claim 1, wherein each of the offset filler, the top insert, and the base insert are formed from honeycomb cardboard.

5. The packaging system of claim 1, wherein the long portion of each of the one or more side panels provides a cushioning effect to the hot water heater with respect to the outer box.

6. The packaging system of claim 1, wherein each side panel comprises a square-shaped or rectangular-shaped cutout.

7. The packaging system of claim 6, wherein the cutout is configured to align with one or more components coupled to the elongated portion of the hot water heater.

8. The packaging system of claim 1, wherein the shape formed by the one or more raised perimeter structures is a circle.

9. The packaging system of claim 1, wherein the base insert comprises an aperture configured to align with a component on or proximate to the bottom surface of the hot water heater.

10. The packaging system of claim 1, further comprising a first pad and a second pad, wherein the first pad is configured to be placed between the top insert and the top inside surface of the outer box, and wherein the second pad is configured to be placed between the base insert and the bottom inside surface of the outer box.

11. A packaging system for a hot water heater, the packaging system comprising:

an outer box configured to contain the hot water heater that comprises a top surface, a bottom surface, and an elongated portion;

a top insert configured to contact the top surface of the hot water heater and a top inside surface of the outer box, the top insert comprising one or more first raised perimeter structures configured to form a first shape that matches a shape of the top surface of the hot water heater;

a base insert configured to contact the bottom surface of the hot water heater and a bottom inside surface of the outer box, the base insert comprising one or more second raised perimeter structures configured to form a second shape that matches a shape of the bottom surface of the hot water heater, wherein the one or more second raised perimeter structures are configured to position the hot water heater at a center axis of the outer box; and a center collar configured to wrap around a mid-portion of the elongated portion of the hot water heater and comprising a plurality of raised patterns, wherein each of the plurality of raised patterns of the center collar is configured to contact the outer box.

12. The packaging system of claim 11, wherein the hot water heater is an electric hot water heater.

13. The packaging system of claim 11, wherein each of the top insert and the base insert are formed from honeycomb cardboard.

14. The packaging system of claim 11, wherein the shape formed by the one or more raised perimeter structures comprises a square or a circle.

15. The packaging system of claim 11, further comprising a first pad and a second pad, wherein the first pad is configured to be placed between the top insert and the top inside surface of the outer box, and wherein the second pad is configured to be placed between the base insert and the bottom inside surface of the outer box.

16. A packaging system for a hot water heater, the packaging system comprising:

an outer box configured to contain the hot water heater comprising a top surface, a bottom surface, and an elongated portion;

a top insert configured to contact the top surface of the hot water heater and a top inside surface of the outer box, the top insert comprising a first perimeter structure configured to form a shape that matches a shape of the top surface of the hot water heater;

a base insert configured to contact the bottom surface of the hot water heater and a bottom inside surface of the outer box, the base insert comprising a second perimeter structure configured to form a shape that matches a shape of the bottom surface of the hot water heater, wherein the first perimeter structure of the top insert and the second perimeter structure of the base insert are configured to position the hot water heater with respect to a center axis of the outer box; and a side object comprising a raised pattern and configured to be sandwiched between the elongated portion of the hot water heater and the outer box;

wherein the first perimeter structure and the second perimeter structure are configured to position the hot water heater off center with respect to the center axis of the outer box.

17. The packaging system of claim 16, further comprising an offset filler coupled to the top insert, the offset filler configured to be sandwiched between the elongated portion of the hot water heater and the outer box.

18. The packaging system of claim 16, wherein the side object comprises a side panel or a center collar, wherein:

the side panel comprises:

a raised pattern; and an L-shape that comprises a short portion and a long portion, wherein the short portion is configured to be inserted between the top insert and the top surface of the hot water heater, and wherein the long portion is configured to be sandwiched between the elongated portion of the hot water heater and the outer box; and the center collar is configured to be coupled around a mid-portion of the elongated portion of the hot water heater and comprises one or more raised patterns, wherein the one or more raised patterns of the center collar is configured to contact the outer box.

19. The packaging system of claim 16, wherein:

the hot water heater is a gas hot water heater or an electric hot water heater;

each of the offset filler, the top insert, and the base insert are formed from honeycomb cardboard; and each side panel comprises a square-shaped or rectangular-shaped cutout.

* * * * *